US010094612B2

(12) United States Patent
Natsume

(10) Patent No.: US 10,094,612 B2
(45) Date of Patent: Oct. 9, 2018

(54) COAT DRYING DEVICE AND COAT DRYING METHOD

(71) Applicant: Nissan Motor Co., Ltd., Yokohama-shi, Kanagawa (JP)

(72) Inventor: Tomoyuki Natsume, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 15/522,802

(22) PCT Filed: Nov. 20, 2014

(86) PCT No.: PCT/JP2014/080768

§ 371 (c)(1),
(2) Date: Apr. 28, 2017

(87) PCT Pub. No.: WO2016/079847

PCT Pub. Date: May 26, 2016

(65) Prior Publication Data

US 2017/0314853 A1 Nov. 2, 2017

(51) Int. Cl.

| | |
|---|---|
| ***F26B 7/00*** | (2006.01) |
| ***F26B 3/22*** | (2006.01) |
| ***B05C 9/14*** | (2006.01) |
| ***F26B 15/00*** | (2006.01) |
| ***F26B 3/04*** | (2006.01) |
| ***F26B 15/12*** | (2006.01) |

(52) U.S. Cl.

CPC ..... *F26B 3/22* (2013.01); *B05C 9/14* (2013.01); *F26B 3/04* (2013.01); *F26B 15/00* (2013.01); *F26B 15/12* (2013.01); *F26B 2210/12* (2013.01)

(58) Field of Classification Search

CPC ..... F26B 3/33; F26B 3/20; F26B 3/00; F26B 3/04; F26B 2210/12; F26B 3/22; F26B 15/12; F26B 15/00; B05C 9/14

USPC ..... 34/270, 271, 272, 423

See application file for complete search history.

(56) References Cited

U.S. PATENT DOCUMENTS

| | | | | |
|---|---|---|---|---|
| 6,062,850 | A * | 5/2000 | Ino | F26B 3/283 34/270 |
| 2003/0163932 | A1* | 9/2003 | Samekawa | B05D 7/14 34/666 |
| 2007/0299558 | A1* | 12/2007 | Nelson | F26B 3/30 700/259 |

(Continued)

FOREIGN PATENT DOCUMENTS

| | | |
|---|---|---|
| CN | 1826184 A | 8/2006 |
| CN | 1932704 A | 3/2007 |

(Continued)

*Primary Examiner* — Kenneth Rinehart
*Assistant Examiner* — Bao D Nguyen
(74) *Attorney, Agent, or Firm* — Global IP Counselors, LLP

(57) ABSTRACT

A coat drying device dries a wet-coated film that is coated on a continuously transported coating object having first and second parts, where the second part has a greater heat capacity than the first part. The coat drying device includes a heat source and a heat source moving device. The heat source provides thermal energy primarily to a coating surface of a second part. The heat source moving device moves the heat source to the second part such that a spacing between the second part and the heat source is maintained within a predetermined range.

8 Claims, 23 Drawing Sheets

(56) References Cited

U.S. PATENT DOCUMENTS

| | | | | |
|---|---|---|---|---|
| 2009/0130328 | A1 | 5/2009 | Ferraro et al. | |
| 2013/0061489 | A1* | 3/2013 | Sato | F26B 3/283 34/267 |
| 2013/0312277 | A1* | 11/2013 | Hihn | F26B 15/14 34/666 |

FOREIGN PATENT DOCUMENTS

| | | | |
|---|---|---|---|
| CN | 102476095 | A | 5/2012 |
| JP | 2-198666 | A | 8/1990 |
| JP | 8-4147 | Y2 | 2/1996 |
| JP | 11-290751 | A | 10/1999 |
| JP | 2000-84464 | A | 3/2000 |
| JP | 2002-188886 | A | 7/2002 |
| JP | 2003-140513 | A | 5/2003 |
| JP | 2011-245412 | A | 12/2011 |
| JP | 5477514 | B2 | 2/2014 |
| WO | 2009/016439 | A1 | 2/2009 |

* cited by examiner

COAT DRYING DEVICE AND COAT DRYING METHOD

CROSS-REFERENCE TO RELATED APPLICATIONS

This application is a U.S. National stage application of International Application No. PCT/JP2014/080768, filed Nov. 20, 2014.

BACKGROUND

Field of the Invention

The present invention relates to a coat drying device and a coat drying method.

Background Information

A conventional technology is known in which, in a coat drying furnace provided in a line in which different types of workpieces with different baking temperatures are mixed, different types of workpieces are respectively collected as lots (made into lots) and fed, the workpieces are heated by a hot air circulation mechanism with respect to workpieces that have the lowest baking temperatures, and the workpieces are heated by a combined use of a hot air circulation mechanism and a far infrared mechanism with respect to workpieces that have higher baking temperatures (refer to Japanese Laid-Open Patent Application No. 2000-84464).

SUMMARY

Bake-cured paint is used for workpieces such as metal vehicle bodies and resin bumpers, where, in intermediate coating and top coating, maintaining 140° C. for 20 minutes is the standard for assuring the quality of the cured coated film. However, if a metal vehicle body and a resin bumper are mounted in proximity on the same coating platform with respect to the above-described conventional coat drying furnace, with the aim of maintaining color matching and the production sequence, since the heat-up times are different due to differences in the material (heat capacity), there is the problem that if the workpiece with the relatively long heat-up time (resin bumper) is heated so as to satisfy the quality assurance standard described above, there is a risk that the workpiece with the relatively short heat-up time (metal vehicle body) will become overheated.

The problem to be solved by the present invention is to provide a coat drying device and a coat drying method that are able to satisfy the drying conditions of a coated film that is coated on a coating object comprising a plurality of parts with different heat capacities.

In order to solve the problem described above, in the present invention, a heat source that primarily supplies thermal energy to a coating surface of a second part having a greater heat capacity than a first part is moved to the second part, and the spacing between the second part and the heat source is maintained within a predetermined range.

According to the present invention, the difference between the heat-up time of the first part and the heat-up time of the second part is suppressed by preheating the second part with a predominantly high heat capacity. It is thereby possible to satisfy predetermined drying conditions of the coated film that is respectively coated on a plurality of parts having different heat capacities.

DETAILED DESCRIPTION OF THE EMBODIMENTS

The following embodiment is a preferred embodiment of the present invention, which will be described using a topcoat drying device 1 to which are applied the coat drying device and coat drying method of the present invention; however, the coat drying device and coat drying method of the present invention may be applied to an intermediate coat drying device, or an intermediate/topcoat drying device described further below.

The topcoat drying device 1 of the present embodiment is one of the devices that constitute a coating line PL and is a device for drying the topcoat coated film that is applied to a coating object B while transporting the coating object B, which is mounted on a coating platform 50. In the following description, first, an overview of the coating line PL and the manufacturing line of an automobile will be described, after which the coating object B and the topcoat drying device 1 will be described in detail.

The manufacturing line of an automobile is primarily configured from four lines, a press molding line PRL, a vehicle body assembly line (also called a welding line) WL, a coating line PL, and a vehicle assembly line (also called an outfitting line) ASL. In the press molding line PRL, various panels that configure a vehicle body B1 are each press-molded, and transported to the vehicle body assembly line WL in a state as single pressed articles. In the vehicle body assembly line WL, a subassembly is assembled for each part of a vehicle body, such as the front body, the center floor body, the rear floor body, and the side bodies, welding is applied to predetermined sites of the assembled front body, center floor body, and rear floor body to assemble the under body, and the side bodies and a roof panel are welded to the under body to assemble the body shell main body B2 (the body shell excluding lids). Finally, lid components such as a hood F, side doors D1, D2, and a back door BD (or trunk lid), which are pre-assembled, are mounted to the body shell main body B2 via hinges. Then, the body shell is transported to the vehicle assembly line ASL via the coating line PL, and various auto parts such as the engine, transmission, suspension system, and interior parts are assembled to the coated body shell.

In addition, the above-described manufacturing line of an automobile comprises a resin member molding line in addition to the four lines described above. In the resin member molding line, resin members such as the bumper, air spoiler, door mirror covers, front grill, various finishers, and door fasteners, are molded by injection molding, press molding, etc., and the finished resin members are washed and dried, after which surface preparation is carried out, in which a conductive primer, or the like, is applied to the resin members.

Figure 1A:
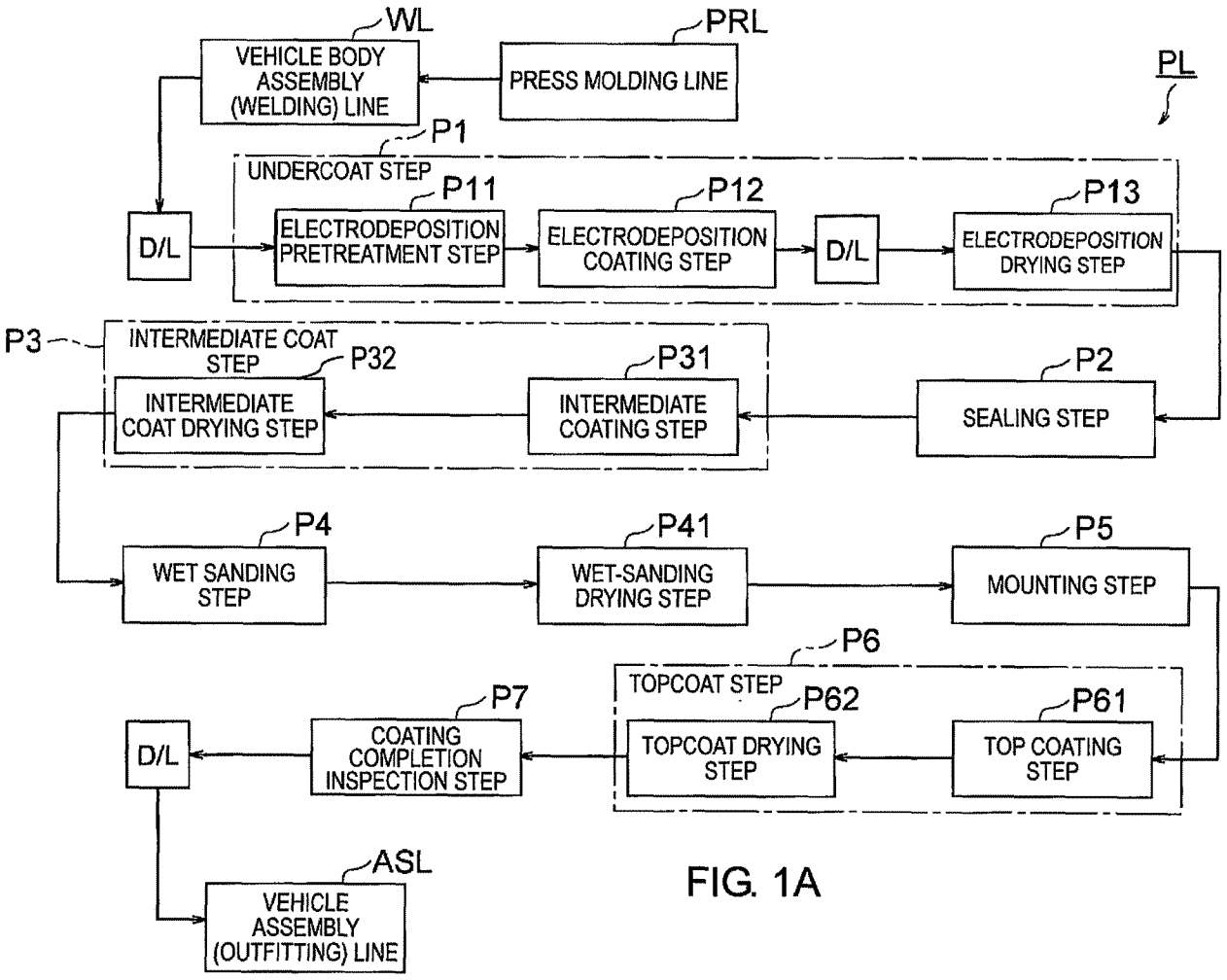
FIG. 1A is an overall process view illustrating one example of a coating line to which is applied one embodiment of the topcoat drying device according to the present invention.
Figure 1B:
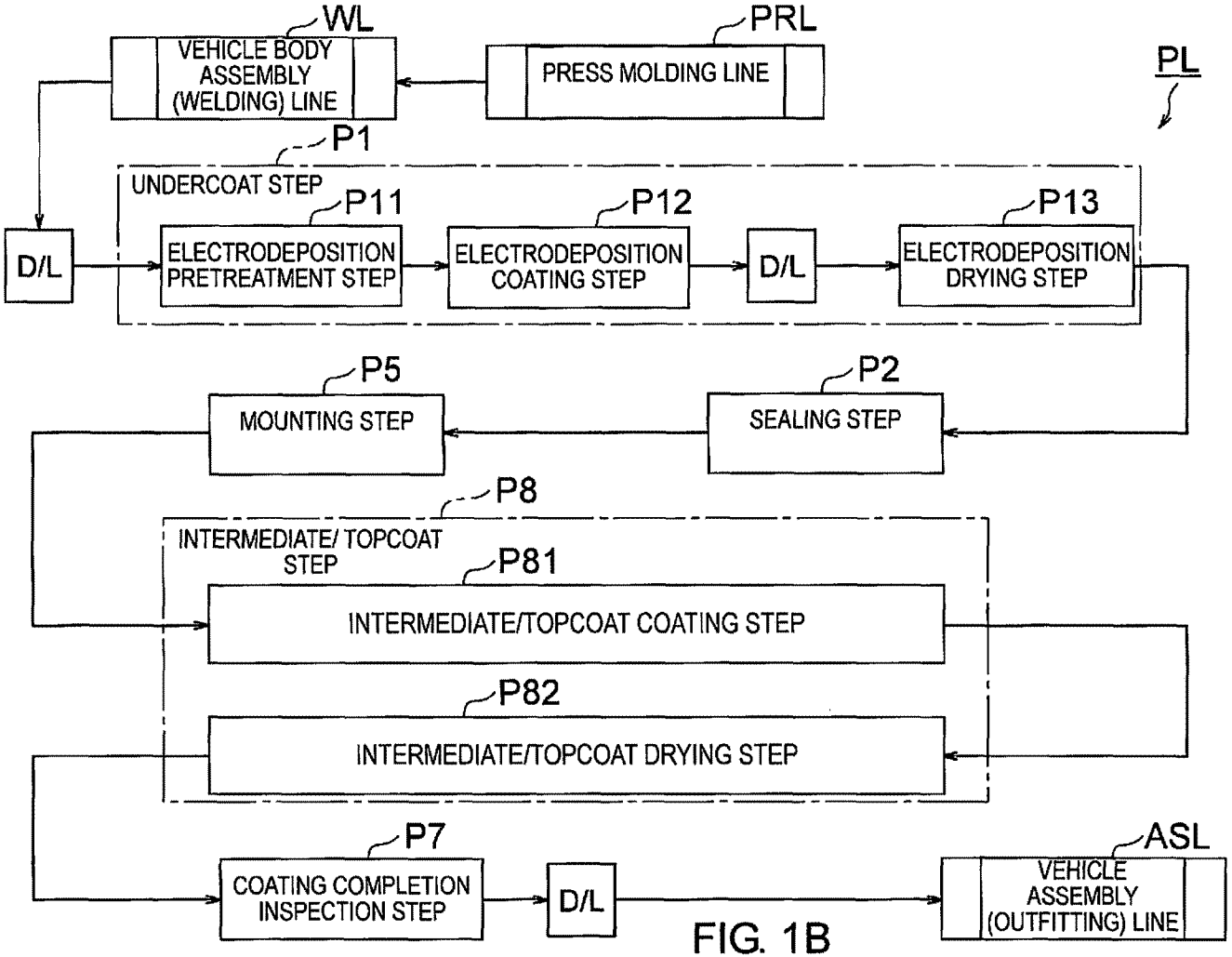
FIG. 1B is an overall process view illustrating one example of a coating line to which is applied one embodiment of the topcoat drying device according to the present invention.

Next, the main configuration of the coating line PL will be described. FIG. 1A and FIG. 1B are both overall process views illustrating examples of a coating line PL comprising a topcoat drying device to which the coat drying device and method according to the present invention are applied. The coating line PL of the embodiment illustrated in FIG. 1A is a coating line according to a three-coat three-bake coating method, said coats comprising an undercoat, an intermediate coat, and a topcoat. In contrast, the coating line PL of the embodiment illustrated in FIG. 1B is a coating line according to a three-coat two-bake coating method, in which the intermediate coating and the top coating are coated in the same coating booth using a wet-on-wet process (application of a coating onto an uncured coated film, hereinafter same), and the intermediate coated film and the top coated film are baked at the same time in the same coat drying furnace. In this manner, the coat drying device and method of the present invention can be applied to any coating line having different coating methods. The coat drying device and method according to the present invention can be applied to modifications of the three-coat three-bake coating method or the three-coat two-bake coating method, such as a four-coat coating method in which the intermediate coat is applied twice, or when the topcoat color is a special, two-tone color, by modifying a part of these types of typical coating lines PL. The coating lines of FIG. 1A and FIG. 1B are described below in parallel; common configurations are denoted by the same reference symbols and are described with reference to the coating line of FIG. 1A, and any differences between the configurations of the two coating lines of FIG. 1A and FIG. 1B will be described with reference to FIG. 1B.

The coating line PL of the embodiment illustrated in FIG. 1A comprises an undercoat Step P1, a sealing Step P2, an intermediate coat Step P3, a wet sanding Step P4, a mounting Step P5, a topcoat Step P6, and a coating completion inspection Step P7. In contrast, the coating line PL of the embodiment illustrated in FIG. 1B comprises an undercoat Step P1, a sealing Step P2, a mounting Step P5, an intermediate/topcoat Step P8, and a coating completion inspection Step P7. That is, in the coating line PL of FIG. 1B, the two steps of the intermediate coating Step P31 and the topcoating Step P61 illustrated in FIG. 1A are carried out in a single step, i.e., the intermediate/topcoating Step P81, in FIG. 1B; similarly, the two steps of the intermediate coat drying Step P32 and the topcoat drying Step P62 illustrated in FIG. 1A are carried out in a single step, i.e., the intermediate/topcoat drying Step P82 of FIG. 1B. The intermediate/topcoat Step P8 of FIG. 1B will be described later further below.

The undercoat Step P1 comprises an electrodeposition pretreatment Step P11, an electrodeposition coating Step P12, and an electrodeposition drying Step P13, as illustrated in FIG. 1A and FIG. 1B. In the electrodeposition pretreatment Step P11, vehicle bodies B1 (white body) that are transferred from a platform of the vehicle body assembly line WL to a coating hanger (not shown) by a drop lifter D/L are continuously conveyed at a predetermined pitch and a predetermined conveying speed by an overhead conveyor. The configuration of the vehicle body B1 will be described further below.

While not shown, the electrodeposition pretreatment Step P11 comprises a degreasing step, a washing step, a surface conditioning step, a chemical film forming step, a washing step, and a draining step. Since press oil, as well as iron powder due to welding and other dust particles, adhere to the vehicle body B1 that is conveyed onto the coating line PL in the press molding line PRL and the vehicle body assembly line WL, such matter is washed and removed in the degreasing step and the washing step. In the surface conditioning step, the surface of the vehicle body B1 is caused to adsorb surface conditioner components, in order to increase the number of reaction origin points in the next step, the chemical film forming step. The adsorbed surface conditioner components become the nucleus of film crystals, and accelerate the film formation reaction. In the chemical film forming step, chemical film is formed on the surface of the vehicle body B1 by immersing the vehicle body B1 into a chemical conversion treatment solution such as zinc phosphate. In the washing step and the draining step, the vehicle body B1 is washed and dried.

In the electrodeposition coating Step P12, vehicle bodies B1, to which pretreatment has been applied by the electrodeposition pretreatment Step P11, are continuously conveyed at a predetermined pitch and a predetermined conveying speed by an overhead conveyor. Then, the vehicle body B1 is immersed in a boat-shaped electrodeposition bath filled with electrodeposition coating, and a high voltage is applied between a plurality of electrode plates provided inside the electrodeposition bath and the vehicle body B1 (specifically, a coating hanger that has electrical conductivity). An electrodeposition film is thereby formed on the surface of the vehicle body B1 due to the electrophoresis action of the electrodeposition coating. An example of electrodeposition coating is a thermoset coating having epoxy resin, such as polyamine resin, as the base resin. Although, from the standpoint of rust prevention, it is preferable that this electrodeposition coating be a cationic electrodeposition coating, in which a positive high voltage is applied to the electrodeposition coating side, an anionic electrodeposition coating, in which a positive high voltage is applied to the vehicle body B1 side, may be used as well.

The vehicle body B1 that has been taken out of the electrodeposition bath of the electrodeposition coating Step P12 is conveyed to the washing step, and electrodeposition coating that has adhered to the vehicle body B1 is washed away using industrial water or pure water. At this time, the electrodeposition coating that is taken out from the electrodeposition bath when the vehicle body is removed from the tank is also recovered in this washing step. When the washing treatment is completed, undried electrodeposition film with a film thickness of 10 μm-35 μm will be formed on the surface, as well as within the pocket structures, of the vehicle body B1 When the electrodeposition coating Step P12 is completed, the vehicle body B1 that is mounted on the coating hanger is transferred onto the coating platform 50 by the drop lifter D/L. It is also possible to dispose the drop lifter D/L, which is disposed between the electrodeposition coating Step P12 and the electrodeposition drying Step P13 illustrated in FIG. 1A and FIG. 1B, between the electrodeposition drying Step P13 and the sealing Step P2, and the vehicle body may be conveyed in the electrodeposition drying Step P13 in a state of being mounted on the coating hanger. The coating platform 50 of the present embodiment will be described below.

In the electrodeposition drying Step P13, vehicle bodies B1 that are mounted on the coating platform 50 are continuously conveyed at a predetermined pitch and a predetermined conveying speed by a floor conveyor. The vehicle body is then baked and dried, for example, by holding a temperature of 160° C.–180° C. for 15-30 minutes, thereby forming dried electrodeposition film with a film thickness of 10 μm-35 μm on the inner and outer panels, as well as within the pocket structures, of the vehicle body B1. Although the coating platform 50, on which are mounted the vehicle bodies B1, is continuously conveyed by the floor conveyor from the electrodeposition drying Step P13 to the coating completion inspection Step P6, the conveying pitch and the conveying speed of the coating platform 50 in each step is in accordance with that step. Accordingly, the floor conveyor is configured from a plurality of conveyors, and the conveying pitch and the conveying speed for each step are set to predetermined values.

In the present Specification and Claims, a reference to a "coating," such as the electrodeposition coating, intermediate coating, and top coating, refers to the liquid state before applying onto a coating object, and a reference to a "coated film," such as the electrodeposition film, intermediate coated film, and top coated film, refers to a film-like undried (wet) or dried state after being coated on the coating object, and the two are distinguished. In addition, in the present Specification and Claims, the upstream side and the downstream side refer to upstream and downstream relative to the conveyance direction of the vehicle body B1 (coating object B). In addition, in the present Specification, conveying the vehicle body B1 (coating object B) in a forward-looking manner means to convey along the longitudinal axis of the vehicle body, with the front portion of the vehicle body B1 on the front side of the conveyance direction, and the rear portion of the vehicle body on the rear side; conveying the vehicle body B1 in a rearward-looking manner means the opposite, that is, conveying along the longitudinal axis of the vehicle body, with the rear portion of the vehicle body B1 on the front side of the conveyance direction, and the front portion of the vehicle body on the rear side. In the undercoat Step P1 to the coating completion inspection Step P7 of the present embodiment, the vehicle body B1 may be conveyed in a forward-looking manner or in a rearward-looking manner.

In the sealing Step P2 (including an undercoat step and a stone guard coat step), vehicle bodies B1, to which electrodeposition film has been formed, are conveyed, and vinyl chloride-based resin sealing material is applied to the steel plate seams and the steel plate edges for the purpose of sealing and rust prevention. In the undercoat step, a vinyl chloride resin-based chipping-resistant material is applied to the tire house and the backside of the floor of the vehicle body B1. In the stone guard coat step, chipping-resistant material made of polyester or polyurethane resin is applied to outer panel bottom portion of the body, such as the side sills, fender, doors, etc. These sealing materials and chipping-resistant materials will be cured in a dedicated drying step or in the intermediate coat drying Step P32 described next.

The intermediate coat Step P3 of the coating line PL of FIG. 1A comprises an intermediate coating Step P31 and an intermediate coat drying Step P32. In the intermediate coating Step P31, vehicle bodies B1, to which electrodeposition film has been formed, are conveyed to an intercoating booth, and an inner panel coating paint, to which is added coloring pigment corresponding to the outer panel color of the vehicle, is applied to the inner panel portions of the vehicle body, such as the engine compartment, hood inner, back door inner, etc., inside the intercoating booth. Then, intermediate coating is applied to the outer panel portions, such as the hood outer, roof outer, door outer, back door outer (or trunk lid outer), etc., by a wet-on-wet process on the inner panel coating film. The outer panel portions are visible portions of a finished vehicle which has completed the outfitting step, and the inner panel portions are portions that are not visible from the outside of the finished vehicle.

In the intermediate coat drying Step P32 of the coating line PL of FIG. 1A, the vehicle body B1 is conveyed to an intermediate coat drying device. The undried intermediate coated film is then baked and dried, for example, by holding a temperature of 130° C.–150° C. for 15-30 minutes, thereby forming intermediate coated film with a film thickness of 15

μm-35 μm on outer panel portions of the vehicle body B1. In addition, inner panel coating film with a film thickness of 15 μm-30 μm is formed on the inner panel portions of the vehicle body B1. The inner panel coating paint and the intermediate coating are thermoset coatings that have acrylic resin, alkyd resin, polyester resin, etc., as a base resin, and may be either a water-based coating or an organic solvent-based coating.

In the wet sanding Step P4 of the coating line PL of FIG. 1A, vehicle bodies B1 that have completed up to the intermediate coat Step P3 are conveyed, and the surface of the intermediate coated film that has been formed on the vehicle body B1 is polished using clean water and a polishing agent. The coating adhesion between the intermediate coated film and the top coated film is thereby improved, and the smoothness (coated skin and clarity) of the top coated film of the outer panel portions is improved. This wet sanding Step P4 comprises a wet-sanding drying Step P41, and in this wet-sanding drying Step P41, moisture that is adhered to the vehicle body B1 is dried by the vehicle body B1 passing through a draining and drying furnace.

In the mounting Step P5 of the coating line PL of FIG. 1A, the resin member (the bumper BP in the present embodiment) that is molded in the above-described resin member molding line is mounted on the coating platform 50, which conveys the vehicle body B1. A bumper BP that has been completed up to the surface preparation is subjected to finish coating (top coating) together with the vehicle body B1 in the subsequent topcoat Step P6. The bumper BP will be described in detail below.

The topcoat Step P6 of the coating line PL of FIG. 1A comprises a top coating Step P61 and a topcoat drying Step P62. In the top coating Step P61, coating objects B are conveyed, including the bumper BP and the vehicle body B1, which have passed through the wet sanding Step P4 and the wet-sanding drying Step P41. Then, in the topcoating booth, a topcoat base paint is applied to the coating surface (outer panel portions) of the coating objects B, and then a topcoat clear paint is applied to the coating surface of the coating objects B by a wet-on-wet process on this topcoat base paint.

The topcoat base paint and the topcoat clear paint are coatings that have acrylic resin, alkyd resin, polyester resin, etc., as a base resin, and may be either a water-based coating or an organic solvent-based coating. The topcoat base paint is coated by being diluted to about 80% by weight ratio (solid content about 20%-40%), with consideration to the finishing qualities, such as the orientation of the luster pigment; in contrast, the topcoat clear paint is coated by being diluted to about 30% by weight ratio (solid content about 70%-80%). However, the coating solid content of the topcoat base paint generally rises to 70% or greater in the flash-off step after coating (a stationary process in which solvents are allowed to evaporate naturally inside a booth).

The outer panel color of the coating object B of the present embodiment is a metallic outer panel comprising various luster pigments such as aluminum, mica, etc., and a topcoat base paint and a topcoat clear paint are applied to the coating object B, but no limitation is imposed thereby. For example, the outer panel color of the coating object B may be a solid outer panel color. A solid outer panel color is a coating color that does not include luster pigment, and in this case, a topcoat base paint is not applied, and a topcoat solid paint is applied instead of the topcoat clear paint. Examples of such topcoat solid paint include coatings that have the same base resin as the topcoat base paint and the topcoat clear paint.

In the topcoat drying Step P62 of the present embodiment, coating objects B to which have been applied the top coating in the topcoating booth are conveyed to the topcoat drying device 1. In this topcoat drying Step P62, coating objects B pass through the topcoat drying device 1 under a predetermined condition, and dried top coated film is thereby formed. The specific configurations of the topcoat drying device 1 and the topcoat drying Step P62 will be described further below.

The film thickness of the topcoat base film is, for example, 10 μm-20 μm, and the film thickness of the topcoat clear film is, for example, 15 μm-30 μm. If the outer panel color of the coating object B is a solid outer panel color, the film thickness of the topcoat solid film is, for example, 15 μm-35 μm. Finally, the vehicle body that has completed coating (coating completed body) is conveyed to the coating completion inspection Step P7, where various tests are carried out in order to evaluate the appearance, clarity, etc. of the coated film.

On the other hand, in the coating line PL illustrated in FIG. 1B, an intermediate/topcoat Step P8 is provided in place of the intermediate coat Step P3, the wet-sanding drying Step P4 (including the wet-sanding drying Step P41), and the topcoat Step P6 of the coating line PL illustrated in FIG. 1A. This intermediate/topcoat Step P8 of the present embodiment comprises an intermediate/top coating Step P81, and an intermediate/topcoat drying Step P82.

In the intermediate/top coating Step P81 of the coating line PL illustrated in FIG. 1B, coating objects B, including the bumper BP and the vehicle body B1, on which an electrodeposition film has been formed, are conveyed to an intermediate/topcoat booth, and an inner panel coating paint, to which is added coloring pigment corresponding to the outer panel color of the vehicle, is applied to the inner panel portions of the vehicle body, such as the engine compartment, hood inner, back door inner, etc., in the first half zone of the intermediate/topcoat booth. Then, intermediate coating is applied to the outer panel portions, such as the hood outer, roof outer, door outer, back door outer (or trunk lid outer), etc., by a wet-on-wet process on the inner panel coating film. Coating of the intermediate coating is not carried out with respect to the bumper BP. Next, similarly in the latter half zone of the intermediate/topcoat booth, a topcoat base paint is applied to the outer panel portions of the coating objects B, including the vehicle body B1 and the bumper BP, and then a topcoat clear paint is applied to the outer panel portions of the coating objects B by a wet-on-wet process on this topcoat base paint. That is, the inner panel coating, intermediate coating, and topcoat base paint and clear paint, are all coated by a wet-on-wet process, and are baked and dried at the same time in one topcoat drying furnace. In order to suppress insufficient side coating and a reduction in clarity caused by overlaying wet-coated film, a flash off step, which raises the coating NV of the wet-coated film that is applied to the coating object B, may be provided after coating the intermediate coating or after coating the topcoat base paint. The inner panel coating paint, the intermediate coating, and the topcoat base paint and clear paint that are used in this embodiment are thermoset coatings that have acrylic resin, alkyd resin, polyester resin, etc., as a base resin, in the same manner as the coatings used in the coating line PL illustrated in FIG. 1A, and may be either water-based coatings or organic solvent-based coatings.

Next, the coating object B in the present embodiment will be described in detail, with reference to FIG. 2A-FIG. 2D.

Figure 2A:
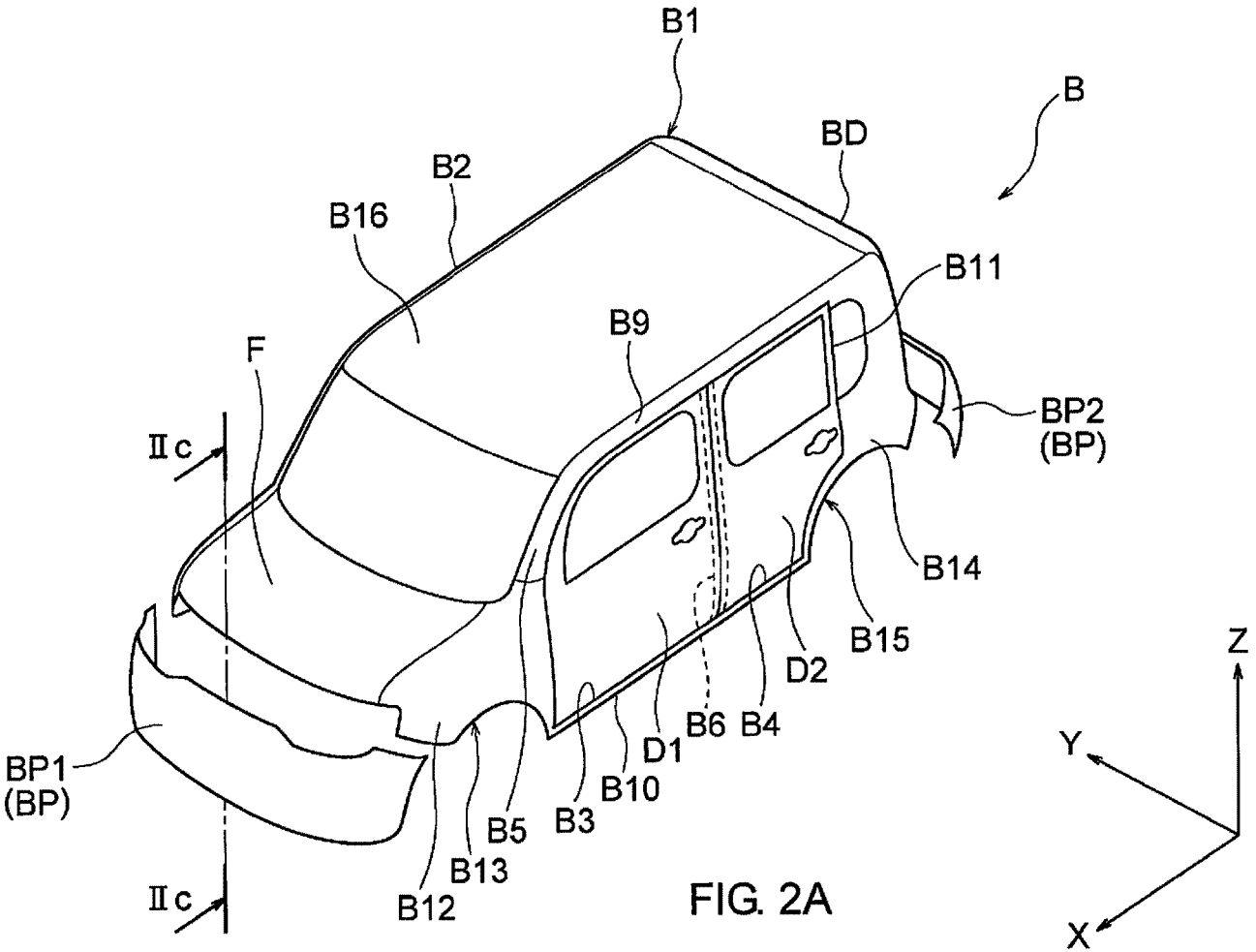
FIG. 2A is a perspective view when viewing a coating object according to one embodiment of the present invention from the front.
Figure 2B:
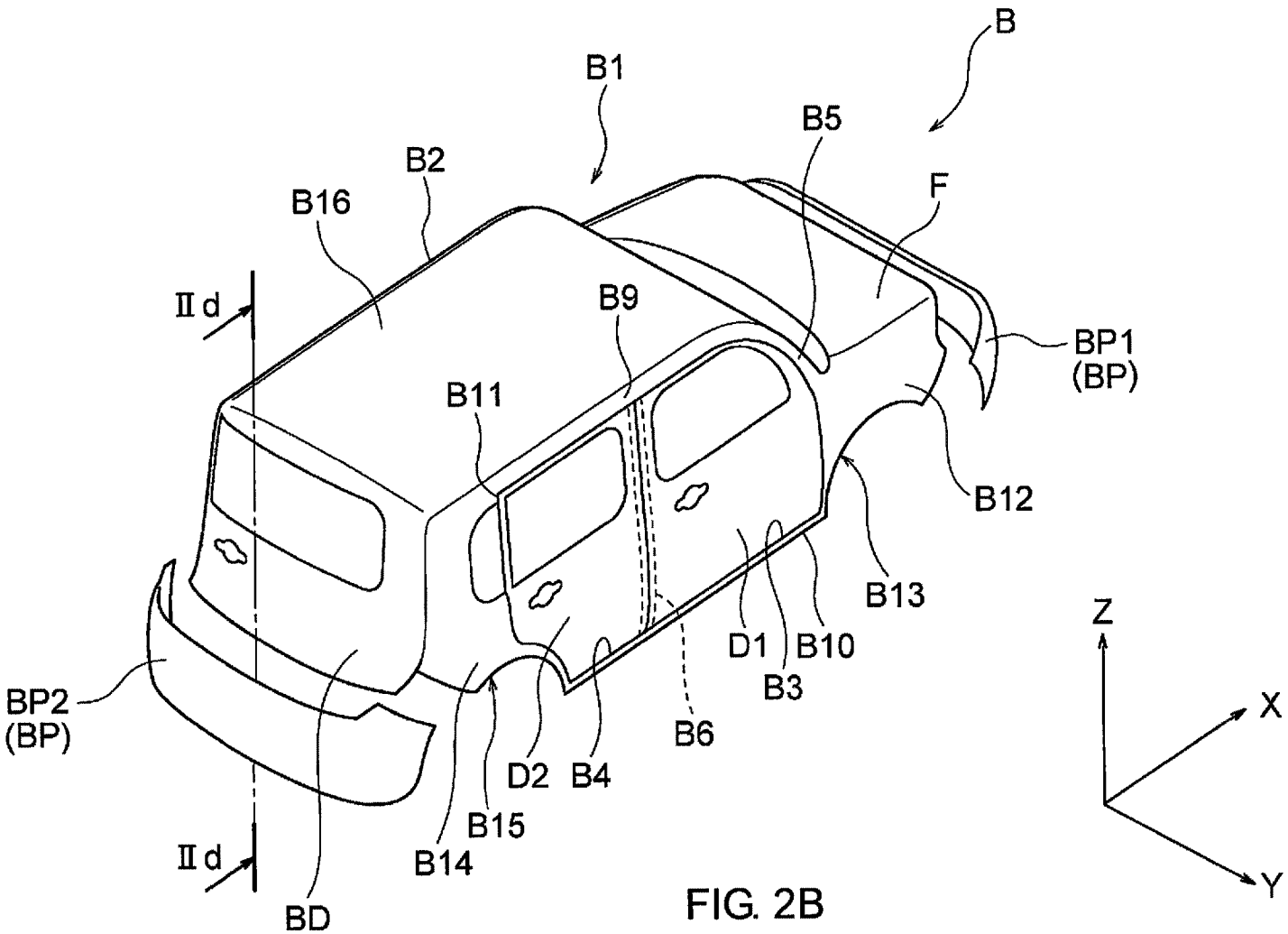
FIG. 2B is a perspective view when viewing a coating object according to one embodiment of the present invention from the rear.
Figure 2C:
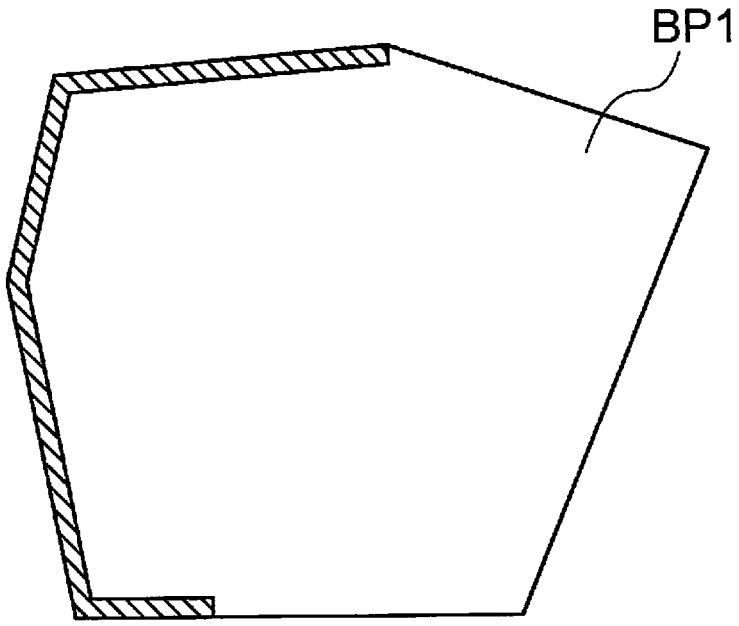
FIG. 2C is a view illustrating a front bumper according to one embodiment of the present invention, which is a cross-sectional view along line IIc-IIc of FIG. 2A.
Figure 2D:
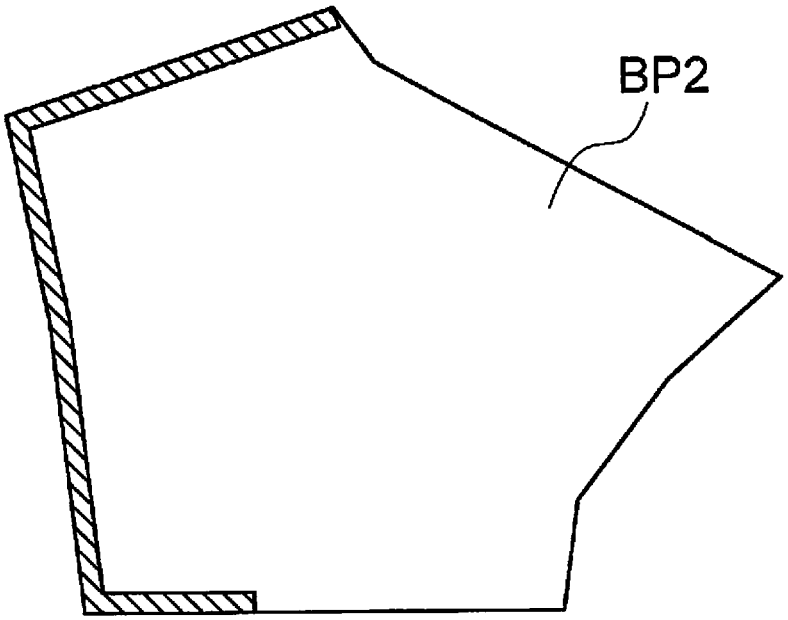
FIG. 2D is a view illustrating a rear bumper according to one embodiment of the present invention, which is a cross-sectional view along line IId-IId of FIG. 2B.

FIG. 2A is a perspective view when viewing the coating object according to one embodiment of the present invention from the front, FIG. 2B is a perspective view when viewing the coating object according to one embodiment of the present invention from the rear, FIG. 2C is a view illustrating a front bumper according to one embodiment of the present invention, which is a cross-sectional view along line IIc-IIc of FIG. 2A, and FIG. 2D is a view illustrating a rear bumper according to one embodiment of the present invention, which is a cross-sectional view along line IId-IId of FIG. 2B.

The coating object B is configured comprising a vehicle body B1 and a bumper BP, as illustrated in FIG. 2A and FIG. 2B. The vehicle body B1 of the present embodiment comprises a body shell main body B2, a hood F, front doors D1, rear doors D2, and a back door BD, which are lid components. Front door openings B3 and rear door openings B4 are formed on both sides of the body shell main body B2. The front door opening B3 is an opening that is defined by a front pillar B5, a center pillar B6, a roof side rail B9, and a side shell B10 of the body shell main body B2. The rear door opening B4 is an opening that is defined by the center pillar B6, a rear pillar B11, the roof side rail B9, and the side shell B10 of the body shell main body B2. Hereinbelow, the front door opening B3 and the rear door opening B4 may be collectively referred to as the door openings B3, B4. The back door BD as the illustrated lid component may be a trunk lid, depending on the vehicle type of the vehicle body B1.

Since the vehicle body B1 of the present embodiment, as illustrated, is a four-door vehicle type, the side doors D comprise a front door D1 and a rear door D2. Two-door sedans and two-door coupes have only a front door D1 and a front door opening B3, and do not have a rear door D2 or a rear door opening B4. The front door D1 of the present embodiment is disposed to correspond to the front door opening B3, and the rear door D2 is disposed to correspond to the rear door opening B4. In this manner, various lid components are attached to the body shell main body B2 of the vehicle body B1, and the productivity of automobiles, which are made by assembling vehicle bodies B1, is thereby made efficient. The "vehicle body B1" of the present embodiment corresponds to one example of the "first part" of the present invention.

The bumper BP is configured comprising a front bumper BP1 and a rear bumper BP2. The front bumper BP1 is a bumper provided to the front of the vehicle body of an automobile, which is made by assembling a bumper BP thereto. The front bumper BP1 extends along the width direction of the vehicle body B1, and is bridged between front fenders B12 of the vehicle body B1, via a front bumper reinforcement, which is a steel plate part, as illustrated in FIG. 2A. In addition, the two ends of the front bumper BP1 are curved along the side surface shape of the front fenders B12. A part of the curved portion of the front bumper BP1 is formed along a front wheel house B13. This front bumper BP1 is formed to be bent outward when viewed in cross section, as illustrated in FIG. 2C.

The rear bumper BP2 is a bumper provided to the rear of the vehicle body of an automobile by assembling a bumper BP thereto. The rear bumper BP2 extends along the width direction of the vehicle body B1, and is bridged between rear fenders B14 of the vehicle body B1, via a rear bumper reinforcement, which is a steel plate part, as illustrated in FIG. 2B. In addition, the two ends of the rear bumper BP2 are curved along the side surface shape of the rear fenders B14. A part of the curved portion of the rear bumper BP2 is formed along a rear wheel house B15. This rear bumper BP2 is formed to be bent outward when viewed in cross section, as illustrated in FIG. 2D. In the present embodiment, the bumper BP is a collective term for the front bumper BP1 and the rear bumper BP2. The "bumper BP" in the present embodiment corresponds to one example of the "second part" of the present invention.

The material forming the vehicle body B1 in the present embodiment is not particularly limited, and examples thereof include metal materials such as steel, and non-ferrous metal materials such as aluminum. In contrast, the material forming the bumper BP is not particularly limited, and examples thereof include urethane resin and polypropylene resin.

In the present embodiment, the heat capacity of the material that forms the bumper BP is relatively greater than the heat capacity of the material that forms the vehicle body B1. The heat capacity of an object is obtained by multiplying the specific heat by the weight of the material that forms the object; for example, if the material that forms the bumper BP is polypropylene, the specific heat of the polypropylene is 1930 J/(g·° C.), whereas, if the material that forms the vehicle body B1 is carbon steel, the specific heat of the carbon steel is 461 J/(g·° C.). Thus, the specific heat of polypropylene that forms the bumper BP has a value that is about four times that of the specific heat of carbon steel that forms the vehicle body B1, and given the difference between the specific heats of these materials, the heat capacity of the material that forms the bumper BP has a greater value than the heat capacity of the material that forms the vehicle body B1.

The bumper BP with a high heat capacity requires a longer time to raise the bumper BP to a predetermined temperature, compared with the vehicle body B1 with a low heat capacity. In this manner, when parts that have different heat capacities (vehicle body B1 and bumper BP) are heated at the same time, if the coating object B is heated up so as to satisfy the quality assurance standard of the bumper BP with a long heat-up time, the heat-up time of the vehicle body B1 will be redundant.

In the present embodiment, "heat capacity" is the amount of heat required to raise the temperature of a certain substance by 1° C. In addition, "specific heat" is the amount of heat required to raise the temperature of 1 g of a certain substance by 1° C. Here, the "amount of heat" refers to thermal energy expressed as a quantity. In addition, in the present embodiment, the coating object B is a collective term for the vehicle body B1 and the bumper BP.

Next, the coating platform 50 in the present embodiment will be described in detail, with reference to FIG. 3A-FIG. 3C.

Figure 3A:
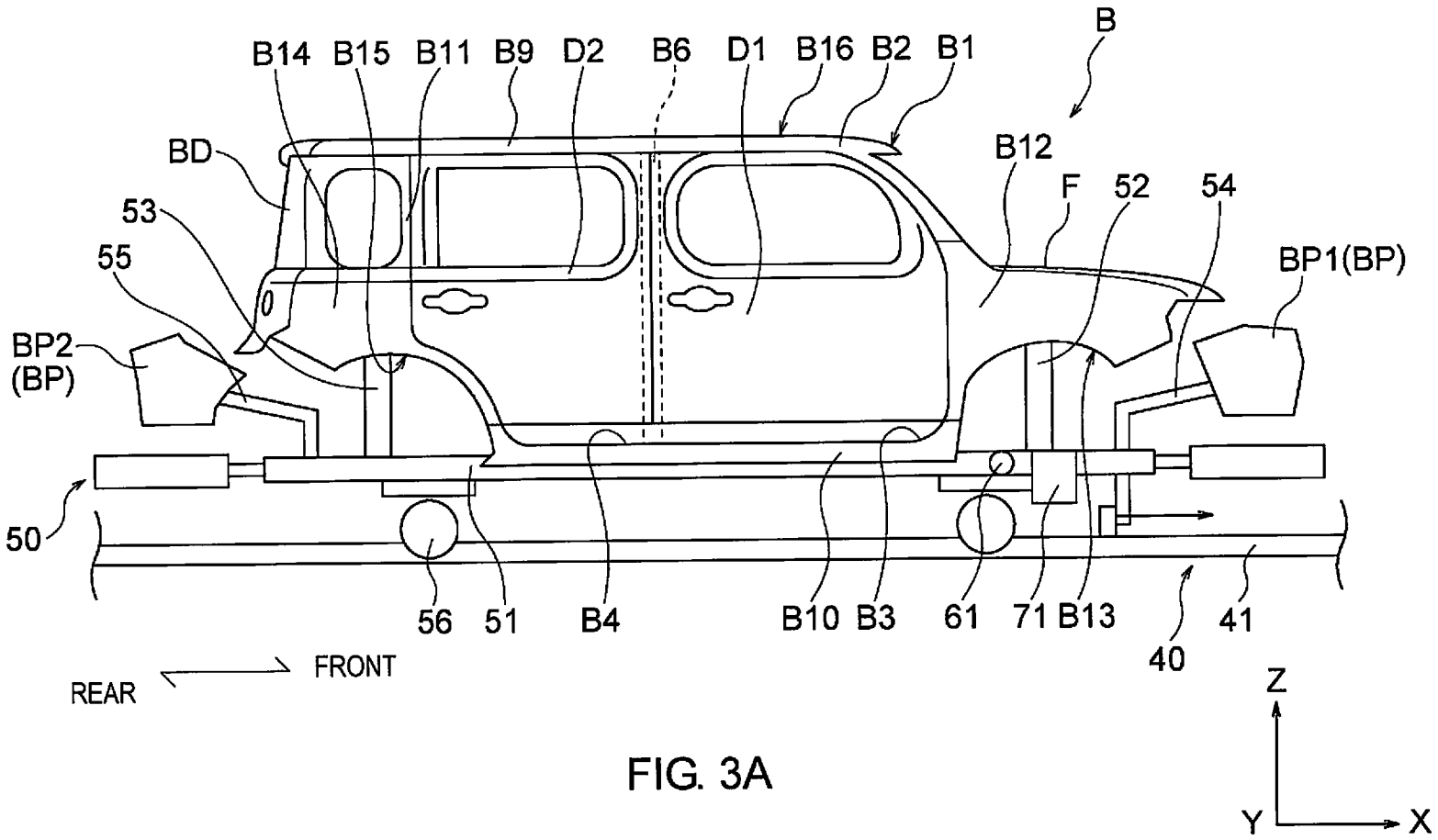
FIG. 3A is a side surface view illustrating a state in which coating objects are mounted on a transport platform according to one embodiment of the present invention.
Figure 3B:
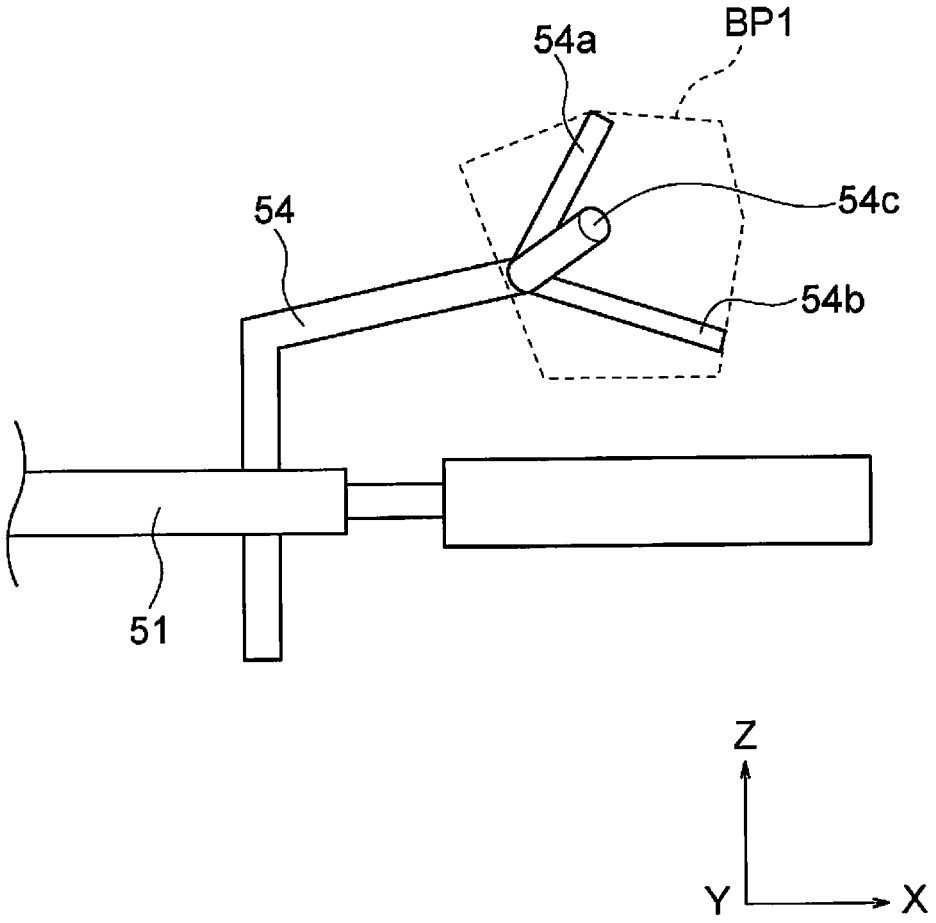
FIG. 3B is a side perspective view illustrating a state in which a front bumper is mounted on a front attachment for bumpers according to one embodiment of the present invention.
Figure 3C:
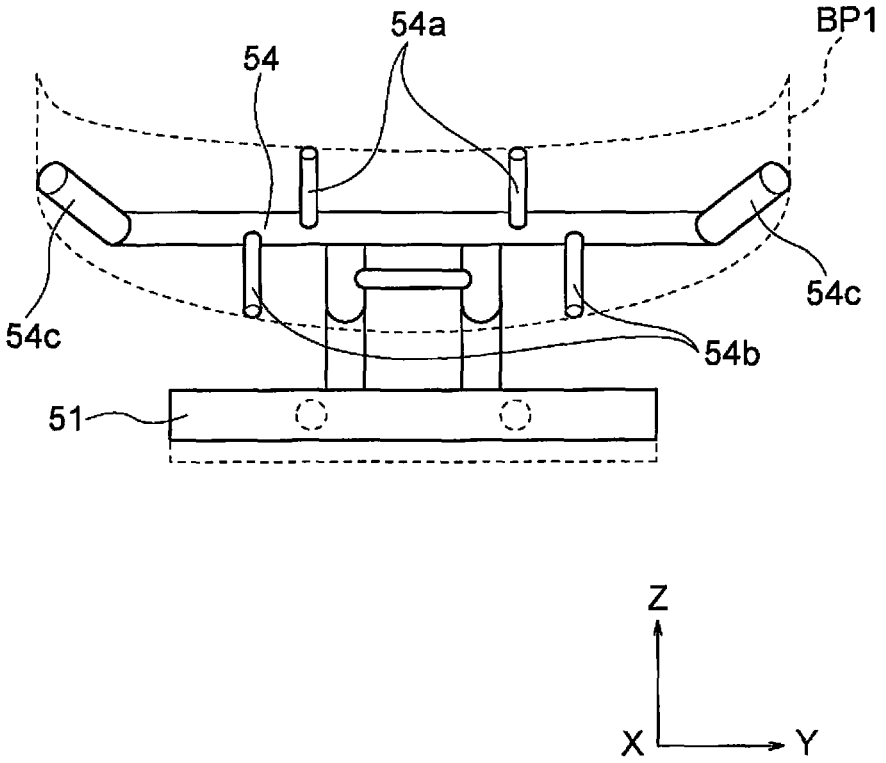
FIG. 3C is a side perspective view illustrating a state in which a front bumper is mounted on a front attachment for bumpers according to one embodiment of the present invention.

FIG. 3A is a side surface view illustrating a state in which coating objects are mounted on a transport platform according to one embodiment of the present invention, FIG. 3B is a side perspective view illustrating a state in which a front bumper is mounted on a front attachment for bumpers according to one embodiment of the present invention, and FIG. 3C is a front perspective view illustrating a state in which a front bumper is mounted on a front attachment for bumpers according to one embodiment of the present invention.

The coating object B described above is conveyed from the electrodeposition drying Step P13 to the coating completion inspection Step P7 in FIG. 1A and FIG. 1B, in a state of being mounted on the coating platform 50. The coating platform 50 of the present embodiment is a rectangular frame in plan view, and comprises a base 51 made of a rigid body that is capable of supporting a vehicle body B1, four wheels 56 that are provided to the lower surface of the base 51, two body front attachments 52 and two body rear attachments 53 provided on the upper surface of the base 51, and a bumper front attachment 54 and a bumper rear attachment 55 provided on the upper surface of the base 51, as illustrated in FIG. 3A.

The left and right body front attachments 52 respectively support the left and right front under bodies (front side members, etc.) of the vehicle body B1, and the left and right body rear attachments 53 respectively support the left and right rear under bodies (rear side members, etc.) of the vehicle body B1. These four attachments 52, 53 support the vehicle body B1 horizontally.

The bumper front attachment 54 is provided on the front side of the base 51, and the front bumper BP 1 can be mounted thereon. Specifically, a plurality of supports 54*a*-54*c*, which correspond to the inner panel side shape of the front bumper BP1, are provided to the bumper front attachment 54, as illustrated in FIG. 3B and FIG. 3C. If the front bumper BP 1 is attached as to cover the bumper front attachment 54, the front bumper BP 1 is supported by the supports 54*a*-54*c*.

The bumper rear attachment 55 is provided on the rear side of the base 51, and the rear bumper BP 2 can be mounted thereon. A plurality of supports that correspond to the inner panel side shape of the rear bumper PB2 are also provided to this bumper rear attachment 55 as well, but since the configuration is the same as the supports 54*a*-54*c* of the bumper front attachment 54 described above, the description thereof is omitted. The four wheels 56 are rotated on their axes along rails 41 that are laid on the left and right of the transport conveyor 40.

As described above, the vehicle body B1 and the bumper BP can be integrally mounted on the coating platform 50. At this time, the positional relationship among the position of the vehicle body B1 to which are attached the body attachments 52, 53, the position of the front bumper BP1 that is attached to the bumper front attachment 54, and the position of the rear bumper BP2 that is attached to the bumper rear attachment 55 preferably substantially matches the positional relationship among the position of the rear bumper BP2, the position of the front bumper BP1, and the position of the vehicle body B1 in the finished vehicle which has completed the outfitting step. By substantially matching the positional relationship of the vehicle body B1 and the bumper BP of the coating object B to the finished vehicle which has completed the outfitting step, and subjecting the vehicle body B1 and the bumper BP to top coating at the same time, it is possible to suppress the occurrence of hue shift in the top coated film between the vehicle body B1 and the bumper BP. It is thus possible to obtain an automobile with excellent appearance.

Next, the topcoat drying device 1 in the present embodiment will be described in detail with reference to FIG. 4A-FIG. 4C.

Figure 4A:
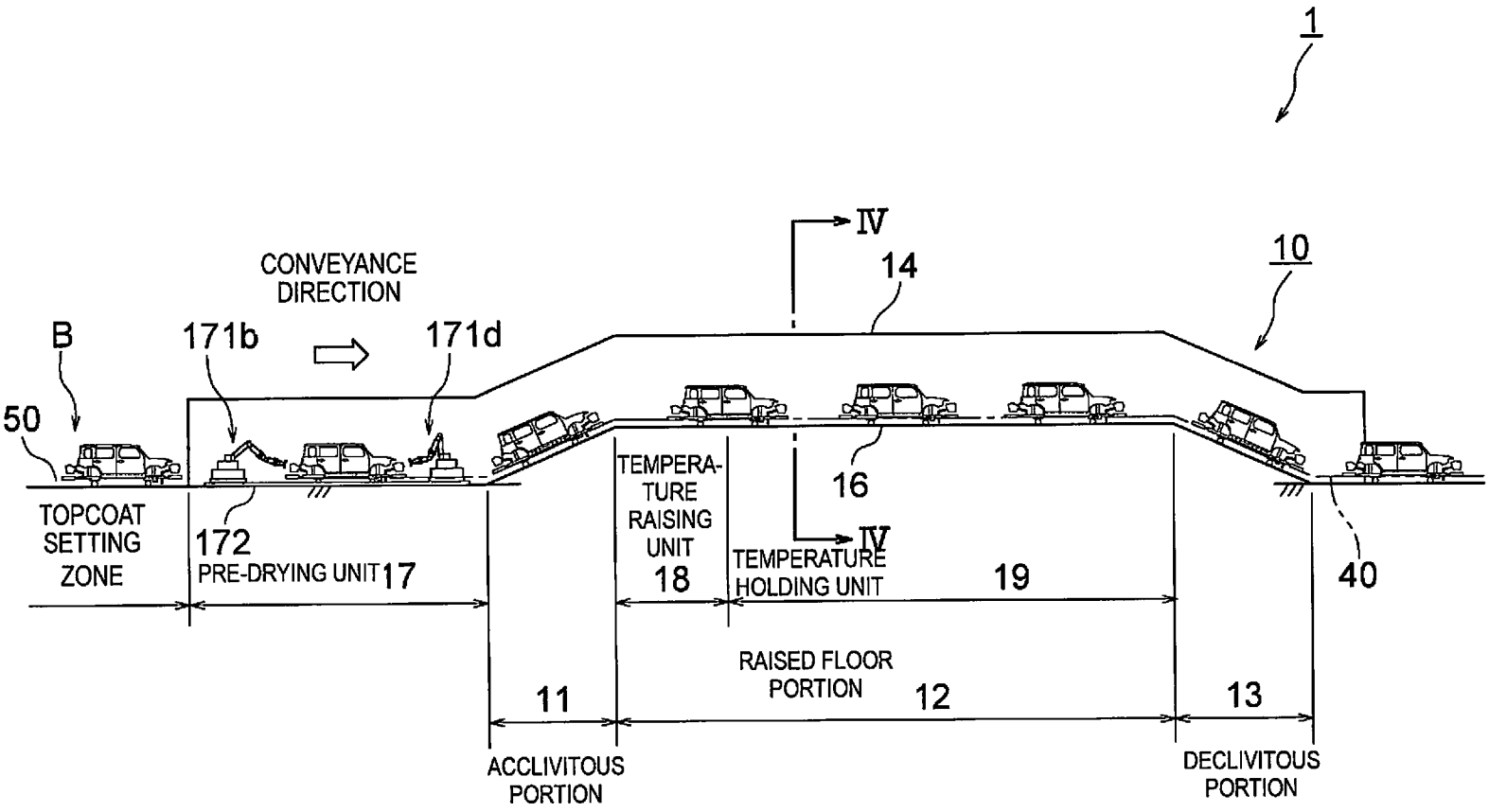
FIG. 4A is a side surface view illustrating a schematic overview of a topcoat drying device according to one embodiment of the present invention.
Figure 4B:
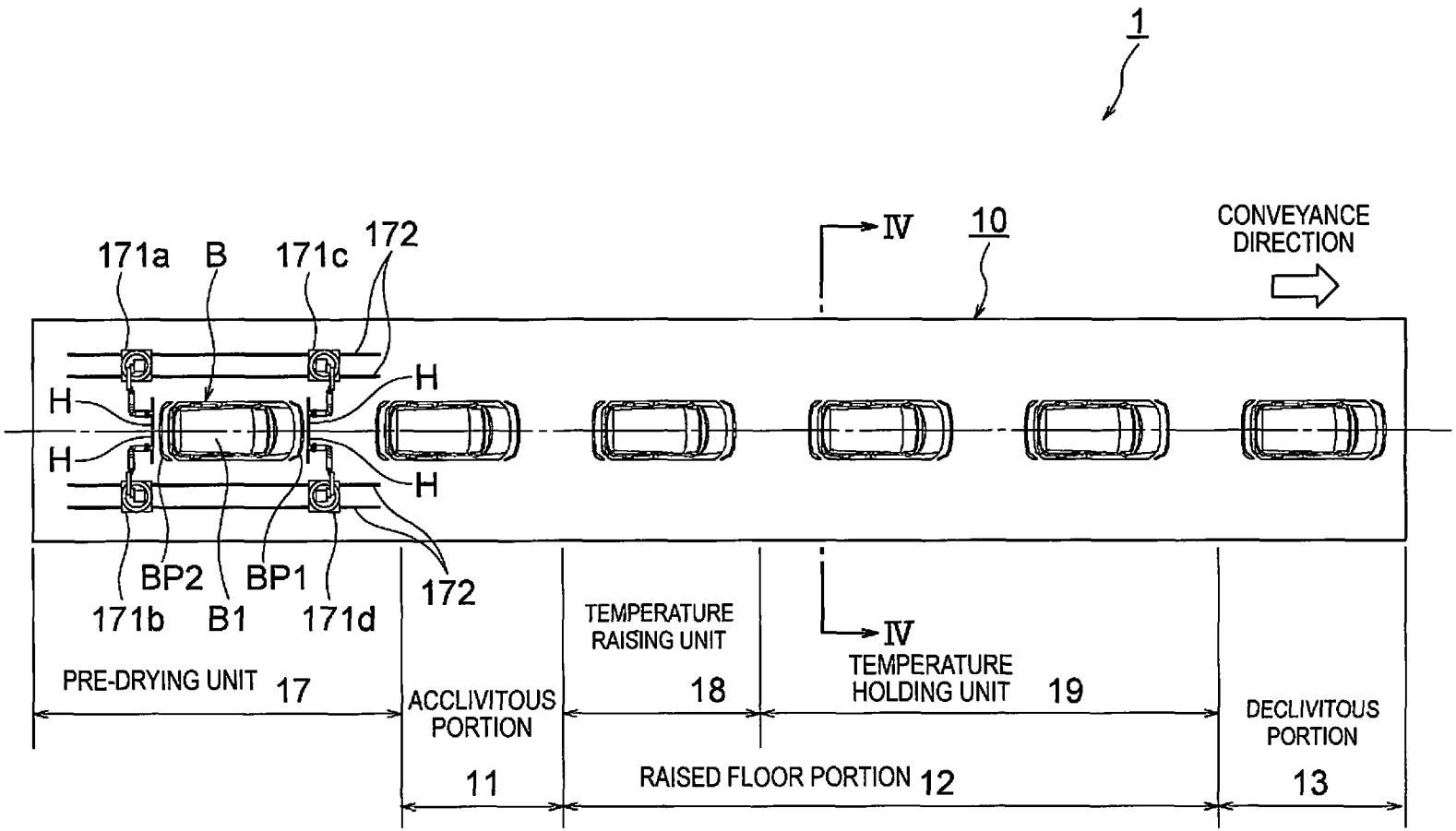
FIG. 4B is a plan view of FIG. 4A.
Figure 4C:
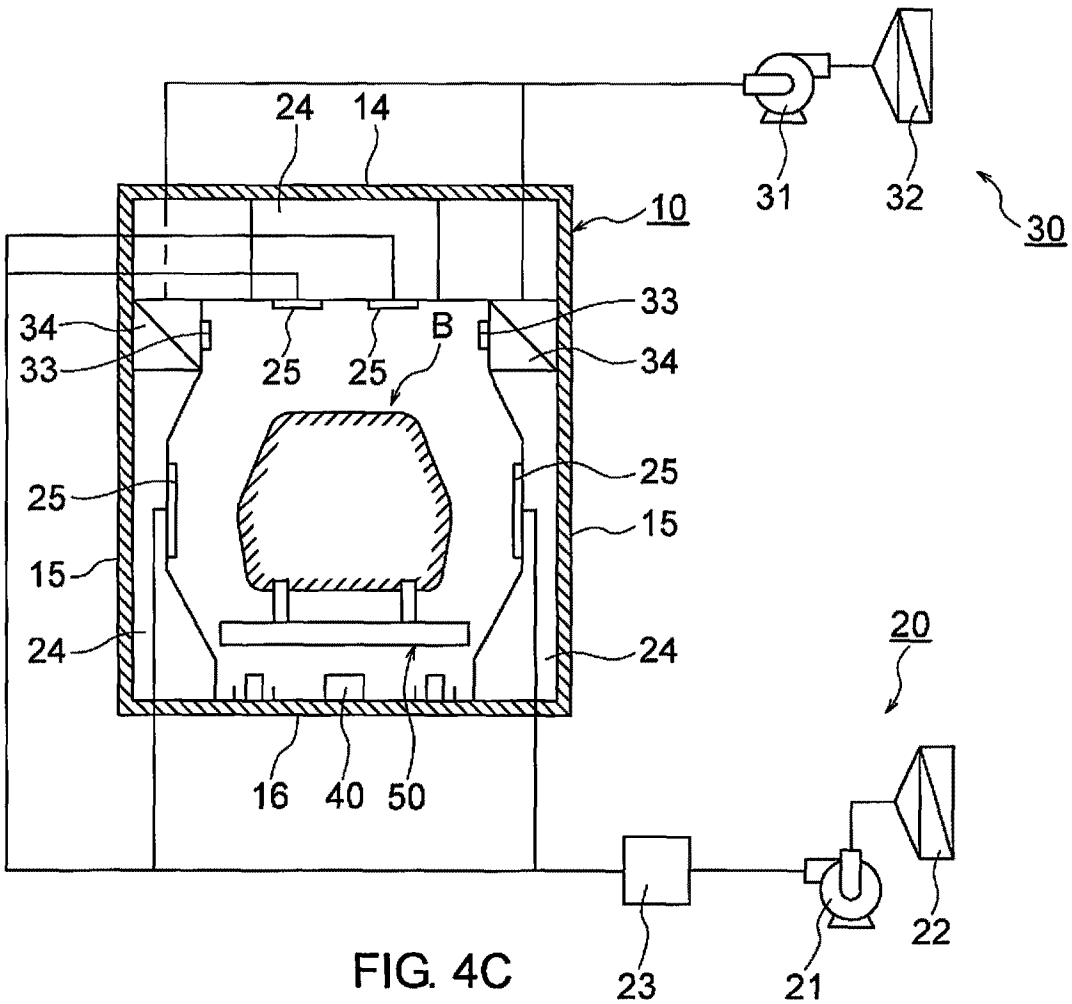
FIG. 4C is a cross-sectional view along line IV-IV of FIG. 3A and FIG. 3B.

FIG. 4A is a side surface view illustrating a schematic overview of a topcoat drying device according to one embodiment of the present invention, FIG. 4B is a plan view of FIG. 4A, and FIG. 4C is a cross-sectional view along line IV-IV of FIG. 3A and FIG. 3B.

The topcoat drying device 1 of the present embodiment comprises a drying furnace main body 10, hot air supply device 20, and an exhaust apparatus 30, as illustrated in FIG. 4A-FIG. 4C. The drying furnace main body 10 of the present embodiment is dome-shaped and comprises an acclivitous portion 11 on the entrance side, a declivitous portion 13 on the exit side, and a raised floor portion 12 between the acclivitous portion 11 and the declivitous portion 13, and is provided with a pre-drying unit 17 between the acclivitous portion 11 and a topcoat setting zone at the terminus of the topcoating booth, as illustrated in the side surface view of FIG. 4A. The pre-drying unit 17 will be described in detail further below. The "pre-drying unit 17" in the present embodiment corresponds to one example of the "pre-drying unit" of the present invention.

Additionally, the drying furnace main body 10 is a rectangular drying furnace having a ceiling surface 14, a pair of left and right side surfaces 15, 15, and a floor surface 16, as illustrated in the cross-sectional views of FIG. 4A and FIG. 4B. In the side surface view of FIG. 4A, the left side is the topcoat setting zone at the terminus of the topcoating booth and the entrance side of the drying furnace main body 10, and the right side is the exit side of the drying furnace main body 10; a coating object B that is mounted on the coating platform 50 is conveyed in a forward-looking manner from left to right in FIG. 4A. That is, the coating object B that is conveyed inside the topcoat drying device 1 of the present embodiment is conveyed in the right direction illustrated in FIG. 3A.

The height of the floor surface 16 of the raised floor portion 12 of the drying furnace main body 10 is substantially the same height as the height of the upper edge of the opening of the drying furnace main body 10 entrance, and as the height of the upper edge of the opening of the drying furnace main body 10 exit. It is thereby possible to prevent the hot air that is supplied to the raised floor portion 12 from escaping outside of the drying furnace main body 10 from the entrance or the exit. A transport conveyor 40, which conveys the coating platform 50 on which is mounted the coating object B, is laid on the floor surface 16 of the drying furnace main body 10 along the direction in which the drying furnace main body 10 extends.

The raised floor portion 12 that becomes the substantial heating region of the topcoat drying device 1 is configured including a temperature raising unit 18 and a temperature holding unit 19, as illustrated in FIG. 4A and FIG. 4B. The temperature raising unit 18 is positioned on the upstream side of the raised floor portion 12 and heats and raises the temperature of the coating object B to a heating temperature threshold Tc. The temperature holding unit 19 is positioned on the downstream side of the temperature raising unit 18 and heats and holds the temperature of the coating object B after the temperature thereof has been raised to at least the heating temperature threshold Tc for a predetermined time. Here, the heating temperature threshold Tc is set on the basis of the curing temperatures of the topcoat base paint and the topcoat clear paint that are used. In the present embodiment, the heating temperature threshold Tc is a value that is on the higher temperature side relative to the curing temperatures of the topcoat base paint and the topcoat clear paint by a predetermined temperature, and is specifically 130° C.-150° C. The "temperature raising unit 18" in the present embodiment corresponds to one example of the "temperature raising unit" of the present invention, and the "temperature holding unit 19" in the present embodiment corresponds to one example of the "temperature holding unit" of the present invention.

The hot air supply device 20 is an apparatus used to supply generated hot air into the raised floor portion 12 of the drying furnace main body 10 and comprises an air supply fan 21, an air supply filter 22, a burner 23, an air supply duct 24, and a hot air outlet 25, as illustrated in FIG. 4C. The "hot air supply device 20" in the present embodiment corresponds to one example of the "hot air generation supply means" of the present invention.

The air supply fan 21 is an apparatus for supplying air that is suctioned from the outside to the inside of the raised floor portion 12 of the drying furnace main body 10. The air supply filter 22 is connected to the suction side of the air supply fan 21 and filters the air that is suctioned from the outside to separate dust, etc. Clean air is thereby drawn into the air supply fan 21. The burner 23 is connected to the discharge side of the air supply fan 21, and heats the air that is discharged from the air supply fan 21 to a predetermined temperature. The suctioned air is thereby supplied inside the raised floor portion 12 of the drying furnace main body 10 as hot air. The air supply duct 24 is disposed to each of the ceiling surface 14 and the left and right side surfaces 15, 15 of the raised floor portion 12 of the drying furnace main body 10, along the conveyance direction of the coating object B, as illustrated in FIG. 4C. The air supply duct 24 of the temperature raising unit 18 to which the hot air outlet 25 is provided, and the air supply duct 24 of the temperature holding unit 19 may be insulated, and an air supply fan 21, an air supply filter 22, and a burner 23 may be provided to each, in order to control the temperature and the flow rate of the hot air that is suctioned to each of the insulated regions.

The hot air outlet 25 is configured from a plurality of rectangular slits (openings), which are disposed at predetermined spacings along the direction in which extends the air supply duct 24, which is disposed inside the raised floor portion 12 of the drying furnace main body 10, as well as airflow direction plates, which are provided to the slits as needed. The hot air outlet 25 is provided such that the opening or the airflow direction plate of each slit faces the central portion of the drying furnace main body 10, and the hot air that is supplied by the air supply fan 21 is thereby blown to the coating object B that is conveyed inside the drying furnace main body 10.

The hot air outlets 25 provided to the left and right side surfaces 15, 15 of the raised floor portion 12 are provided such that the opening or the airflow direction plate is oriented toward the bumper BP and the outer panel portions of the vehicle body B1, such as the front fender B12, the side door D, the side sill B10, and the rear fender B14, when the coating object B passes in front of the hot air outlet 25. In addition, the hot air outlet 25 that is provided to the ceiling surface 14 is positioned such that the opening or the airflow direction plate is oriented toward the bumper BP of the coating object B and the outer panel portions of the vehicle body B1, such as the hood F, the roof B16, and the back door BD, when the coating object B passes in front of the hot air outlet 25. Hot air is blown onto the entire coating object B by said hot air outlet 25, and the entire coating object B, including the outer panel portions, is heated and the temperature thereof raised and held.

The exhaust apparatus 30 provided to the raised floor portion 12 is an apparatus for discharging the solvent that evaporates inside the drying furnace main body 10 to the outside of the system and comprises an exhaust fan 31, an exhaust filter 32, an exhaust duct 33, and an exhaust inlet 34, as illustrated in FIG. 4C. The exhaust fan 31 draws the hot air from the interior of the drying furnace main body 10 and discharges same to the outside of the drying furnace main body 10, or circulates the same to the primary side of the hot air supply device 20, and is responsible for the function of adjusting the hot air pressure and removing dust, etc., from the interior of the drying furnace main body 10. The exhaust filter 32 is provided on the discharge side of the exhaust fan 31. The hot air is drawn by the exhaust fan 31, passes through the exhaust filter 32, and is discharged to the outside of the system or returned to the hot air supply device 20. The exhaust duct 33 is provided to each of the left and right side surfaces 15, 15 of the drying furnace main body 10 along the conveyance direction of the coating object B. The exhaust inlet 34 is made up of slits formed, at predetermined spacings, to the exhaust duct 33, which is disposed inside the drying furnace main body 10.

Next, the pre-drying unit 17 of the drying furnace main body 10 in the present embodiment will be described in detail with reference to FIG. 4D and FIG. 4E.

Figure 4D:
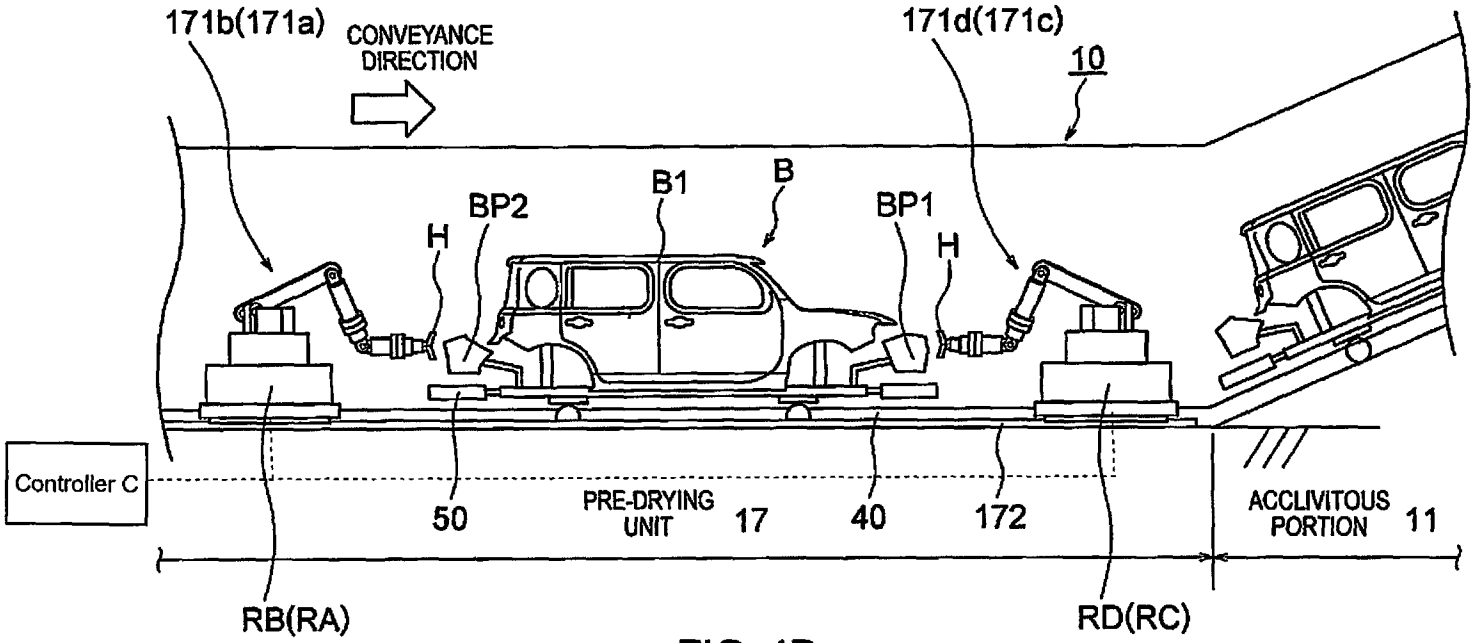
FIG. 4D is a side surface view illustrating a schematic overview of a preheating unit of a topcoat drying device according to one embodiment of the present invention.
Figure 4E:
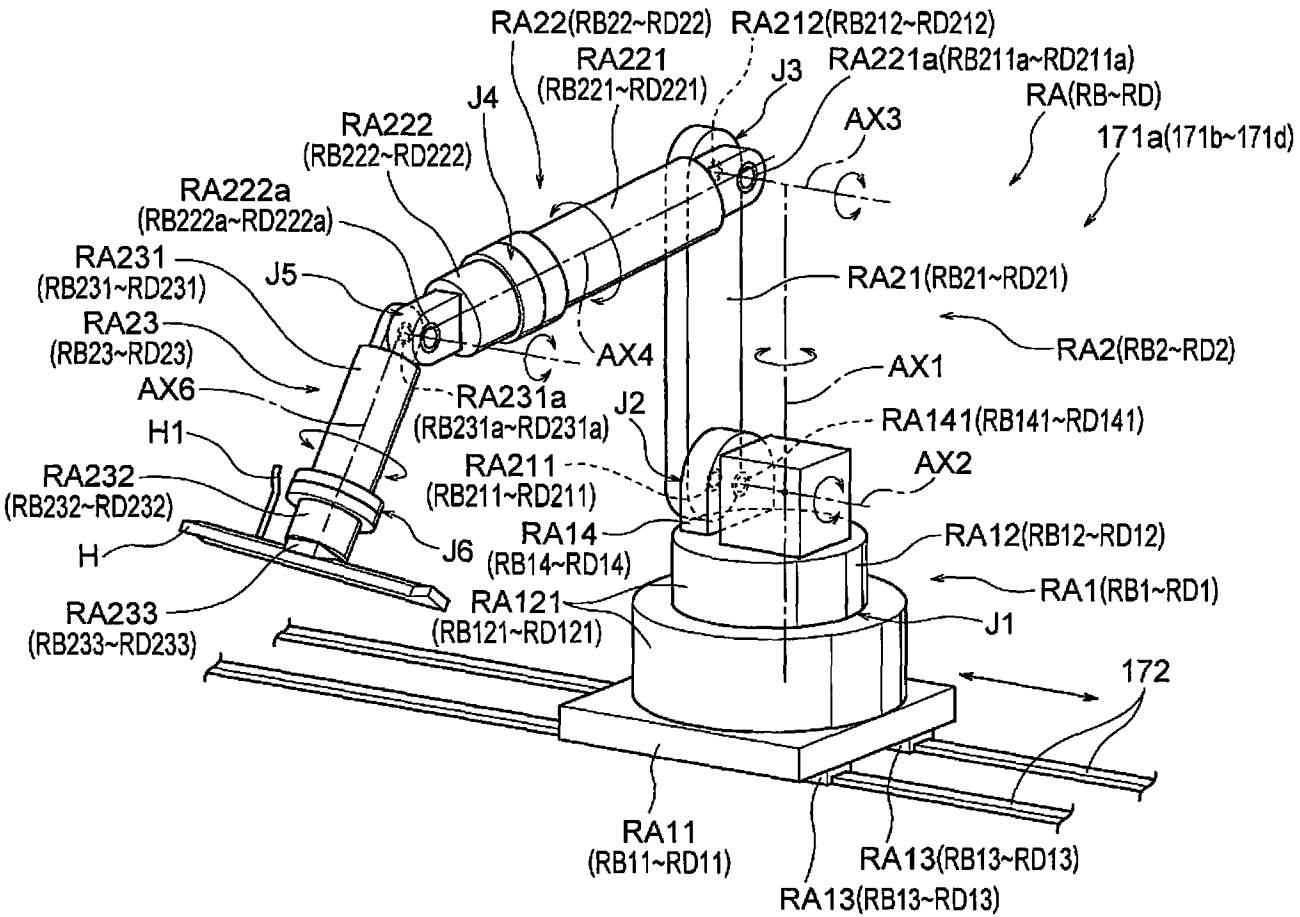
FIG. 4E is a perspective view illustrating a schematic overview of the preheating mechanism according to one embodiment of the present invention.

FIG. 4D is a side surface view illustrating a schematic overview of a preheating unit of a topcoat drying device according to one embodiment of the present invention, and FIG. 4E is a perspective view illustrating a schematic overview of the preheating mechanism according to one embodiment of the present invention.

The pre-drying unit 17 is a rectangular furnace body comprising a ceiling surface 14, a pair of left and right side surfaces 15, 15, and a floor surface 16; a transport conveyor 4 is laid horizontally, and a coating object B is conveyed with a horizontal orientation, as illustrated in FIG. 4A, FIG. 4B, and FIG. 4D. In the pre-drying unit 17 of the present embodiment, of the vehicle body B1 and the bumper BP, which are integrally mounted on the coating platform 50, the bumper BP is selectively heated to compensate for the heating condition in the above-described raised floor portion 12.

As shown in FIG. 4D, to each of the two sides of said pre-drying unit 17, two preheating mechanisms 171*a*-171*d* are provided (for a total of four). Said preheating mechanisms 171*a*-171*d* are disposed on moving rails 172 laid along the conveyance direction, in order to be able to follow the coating object B that is conveyed by the transport conveyor 40.

First, the preheating mechanism 171*a* will be described in detail below. The preheating mechanism 171*a* comprises a multi-axis robot RA and a heat source H, as illustrated in FIG. 4E. The multi-axis robot RA comprises a base unit RA1 and an arm unit RA2. The base portion RA1 comprises a stage RA11, a rotary base portion RA12, a traveling portion RA13, and a bearing portion RA14. The stage RA11 is a rectangular frame in plan view and is a rigid body capable of supporting the weight of the multi-axis robot RA. A rotary base portion RA12 is provided on the upper surface of this stage RA11, and two traveling portions RA13 are provided on the bottom surface of the stage RA11. The rotary base portion RA12 comprises two cylindrical members RA121, RA121: one cylindrical member RA121 is fixed to the stage RA11, and the other cylindrical member RA121 is superimposed thereon. The traveling portion RA13 is provided to extend in the direction along the moving rails 172 and is slidably engaged with the moving rails 172. The bearing portion RA14 is provided on the rotary base portion RA12, and a connecting portion RA141 is formed along the thickness direction thereof.

The arm unit RA2 comprises a first arm portion RA21, a second arm portion RA22, and a third arm portion RA23. The first arm portion RA21 is a rod-like member, and connecting portions RA211, RA212 are formed on both ends thereof. The second arm portion RA22 comprises a first rod-like member RA221 and a second rod-like member RA222. A connecting portion RA221*a* is formed at one end of the first rod-like member RA221. A connecting portion RA222*a* is formed at one end of the second rod-like member RA222. The first and the second rod-like members RA221, RA222 are arranged end to end along the axial direction of said members, and the end of the first rod-like member RA221 that is opposite to the end on which the connecting portion RA221*a* is formed and the end of the second rod-like member RA222 that is opposite to the end on which the connecting portion RA222*a* is formed are arranged facing each other.

The third arm portion RA23 comprises a third rod-like member RA231, a fourth rod-like member RA232, and a hand portion RA233. A connecting portion RA231*a* is formed at one end of the third rod-like member RA231. A hand portion RA233 that holds a heat source H is provided on one end of the fourth rod-like member RA232. The third and the fourth rod-like members RA231, RA232 are arranged end to end along the axial direction of said members, and the end of the third rod-like member RA231 that is opposite to the end on which the connecting portion RA231*a* is formed and the end of the fourth rod-like member RA232 that is opposite to the end on which the hand portion RA233 is formed are arranged facing each other.

In the multi-axis robot RA of the present embodiment, two cylindrical members RA121 are coupled at a first joint J1, as illustrated in FIG. 4E. In addition, connecting portions RA141, RA211 are connected to rotatably couple the bearing portion RA14 (base portion RA1) and the first arm portion RA21 at a second joint J2. Additionally, connecting portions RA212, RA221*a* are connected to rotatably couple the first arm portion RA21 and the second arm portion RA22 at a third joint J3. Furthermore, the first and second rod-like members RA221, RA222 are rotatably coupled at a fourth joint. Additionally, connecting portions RA222*a*, RA231*a* are connected to rotatably couple the second arm portion RA22 and the third arm portion RA23 at a fifth joint. Furthermore, the third and fourth rod-like members RA231, RA232 are rotatably coupled at a sixth joint.

That is, in the multi-axis robot RA of the present embodiment, the first arm portion RA21 is rotatable horizontally (about the axis of rotation AX1) or vertically (about the axis of rotation AX2) with respect to the base portion RA1; the second arm portion RA22 is rotatable about the axis of rotation AX3 with respect to the first arm portion RA21, as well as being capable of twisting rotation about the axis of rotation AX4; and the third arm portion RA23 is rotatable about the axis of rotation AX5 with respect to the second arm portion RA22, as well as being capable of twisting rotation about the axis of rotation AX6. The multi-axis robot RA of the present embodiment is a robot having a rotary operation mechanism that is capable of moving with six degrees of freedom, as described above, but may have, in addition to the foregoing description, operation mechanisms such as telescoping operation, parallel linking operation, and the like.

The heat source H is held by the hand portion RA233 that is provided on the distal end of the arm unit RA2 of the multi-axis robot RA. The heat source H of the present embodiment is a heat source for selectively raising the temperature of the bumper BP. This heat source H is capable of generating heat by electrical power supplied thereto from a heating circuit (not shown) via a power supply cable Hl. The ON and OFF of this heat source H is managed by, for example, detectors such as a limit switch provided to the floor surface and the coating platform 50. Specifically, the current position of the coating object B being conveyed is detected by the detector and electrical power is supplied to the heat source H from the heating circuit only when the heat source H is facing the heating object (bumper BP) to turn ON the heat source H, whereas, in other cases (for example, between vehicle bodies, or while the vehicle body B1 is passing in front of the heat source H), the supply of electrical power from the heating circuit to the heat source H is stopped to turn OFF the heat source H.

While not particularly limited, specific examples of this heat source H include infrared heaters, halogen heaters, and induction heaters. Hot air may be used as the heat source H as well. When using hot air as the heat source H, a hose may be provided, which can expand from the hot air generating device to the hand portion RA233 of each multi-axis robot RA-RD, and hot air may be blown from the end of the hose that is held by the hand portion RA233. The "heat source H" in the present embodiment corresponds to one example of the "heat source" of the present invention, and the "hot air generating device" in the present embodiment corresponds to one example of the "hot air generating means" of the present invention.

The preheating mechanism 171*b* comprises a multi-axis robot RB and a heat source H; the preheating mechanism 171*c* comprises a multi-axis robot RC and a heat source H; and the preheating mechanism 171*d* comprises a multi-axis robot RD and a heat source H. The preheating mechanisms 171*a*-171*d* have some differences in shape, depending on whether to have the front bumper BP1 as the heating object or the rear bumper BP2 as the heating object, or on whether the disposition thereof is to the left or to the right of the coating object B, but the basic structures thereof are the same. Therefore, the preheating mechanism 171*a* is illustrated in FIG. 4E, and the drawings and descriptions of the other preheating mechanisms 171*b*-171*d* will be omitted, with the corresponding reference symbols in parentheses. The "multi-axis robots RA-RD" in the present embodiment corresponds to one example of the "heat source moving means" of the present invention.

In the present embodiment, the width of the heat source H is about half the width of the bumper BP, and the rear bumper BP2 of the coating object B is heated by heat sources H, H of the preheating mechanisms 171*a*, 171*b*. On the other hand, the front bumper BP1 of the coating object B is heated by heat sources H, H of the preheating mechanism 171*c*, 171*d*. Specifically, the heat sources H, H of the preheating mechanisms 171*a*, 171*b* are arranged side by side in the horizontal direction and opposite to the rear bumper BP2 to selectively heat the rear bumper BP2 (refer to FIG. 4B). Similarly, the heat sources H, H of the preheating mechanisms 171*c*, 171*d* are arranged side by side in the horizontal direction and opposite to the front bumper BP1 to selectively heat the front bumper BP1 (refer to FIG. 4B). In this manner, in the present embodiment, two heat sources are arranged side by side to heat the entire coating surface of the bumper BP. The width of the heat source H may be a length that corresponds to the width of the bumper BP. In this case, one each of the preheating mechanisms (heat source H) may be provided to correspond to each of the front bumper BP1 and rear bumper BP2.

Next, the topcoat drying Step P62 of the present embodiment will be described.

Figure 5A:
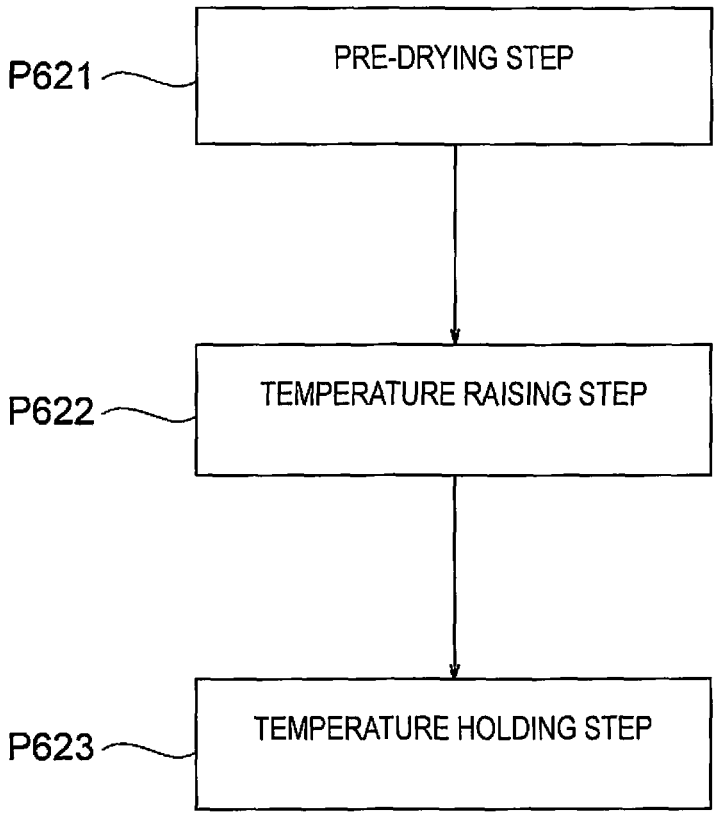
FIG. 5A is a process view illustrating a topcoat drying Step P62 according to one embodiment of the present invention.
Figure 5B:
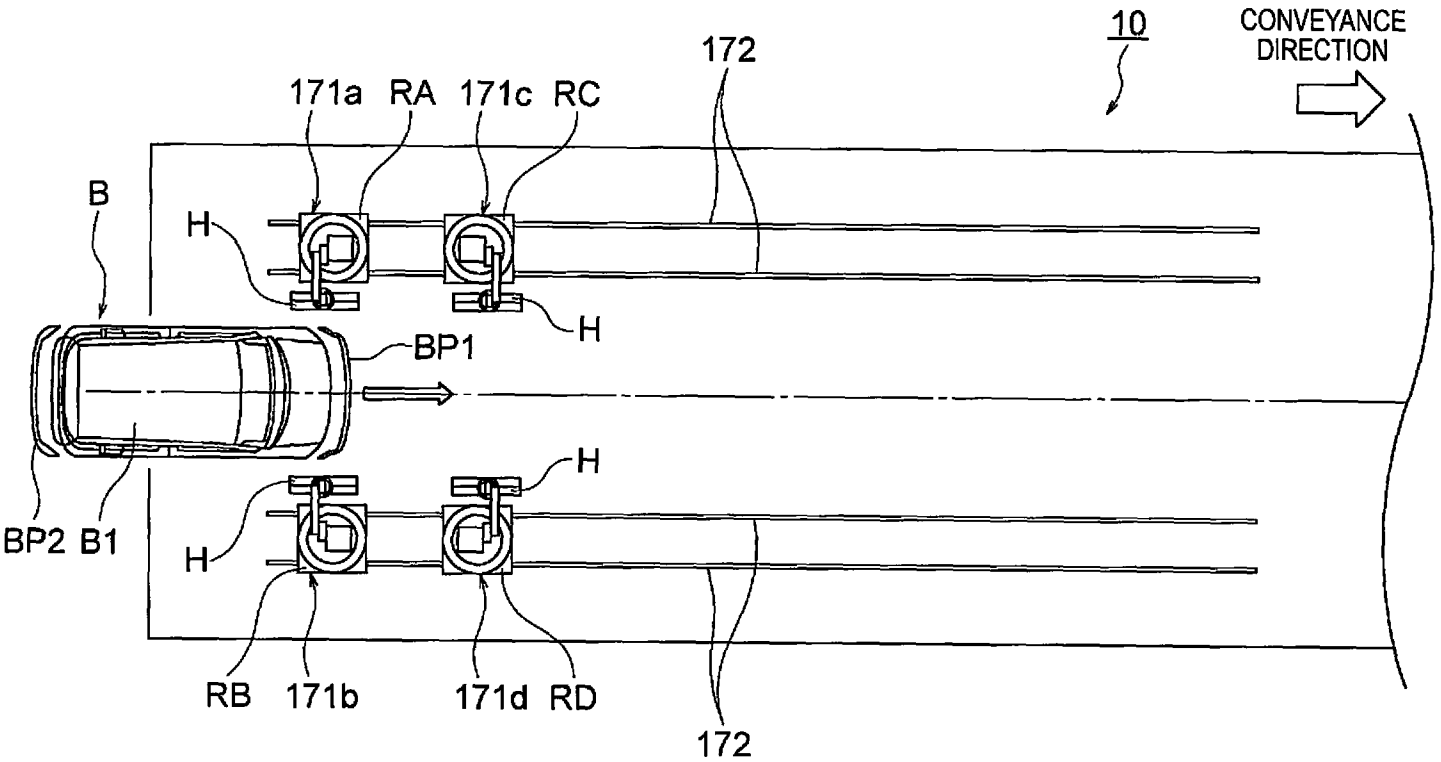
FIG. 5B is a plan view illustrating an operation (part 1) of the preheating mechanism of the preheating unit of the topcoat drying device according to one embodiment of the present invention.
Figure 5C:
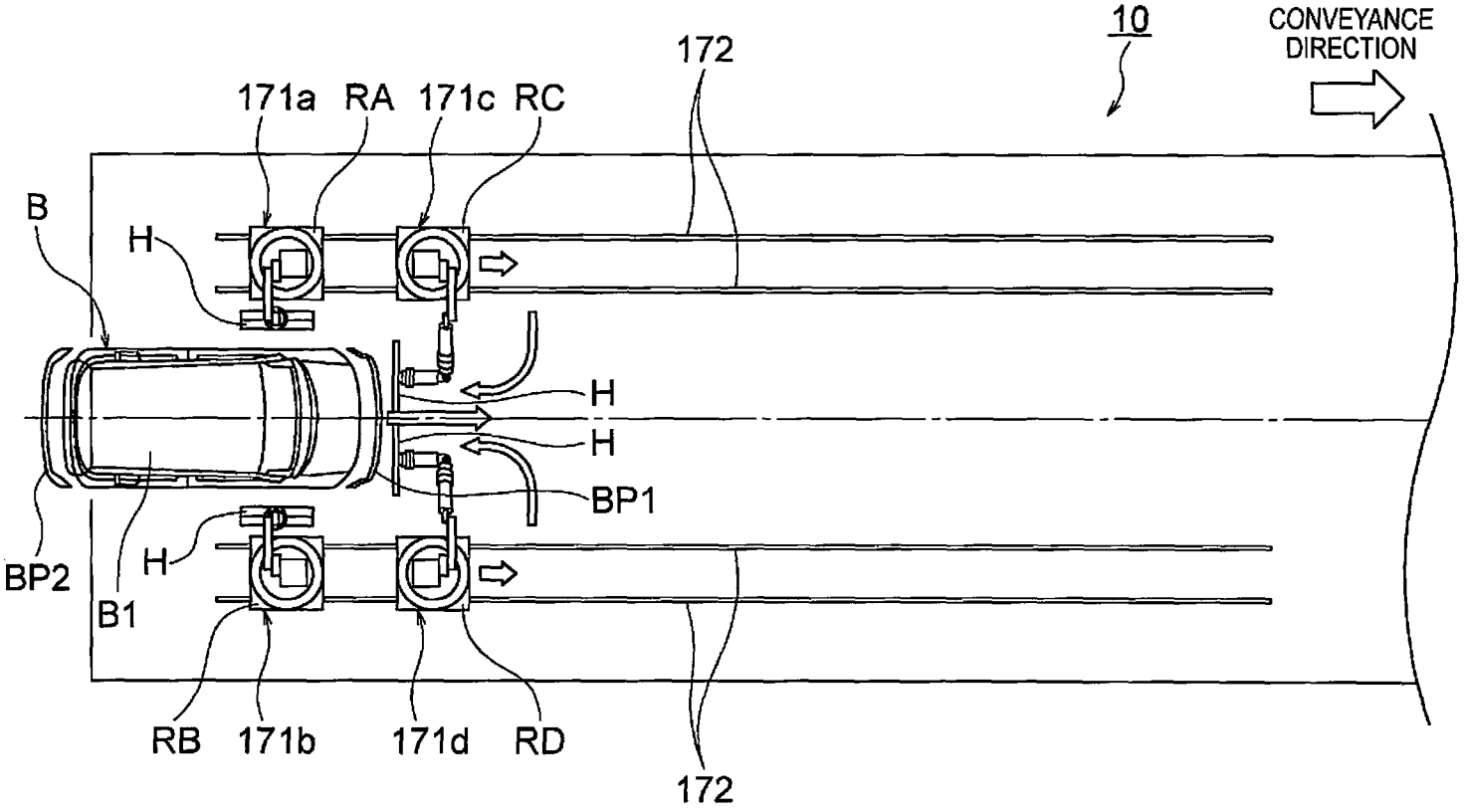
FIG. 5C is a plan view illustrating an operation (part 2) of the preheating mechanism of the preheating unit of the topcoat drying device according to one embodiment of the present invention.
Figure 5D:
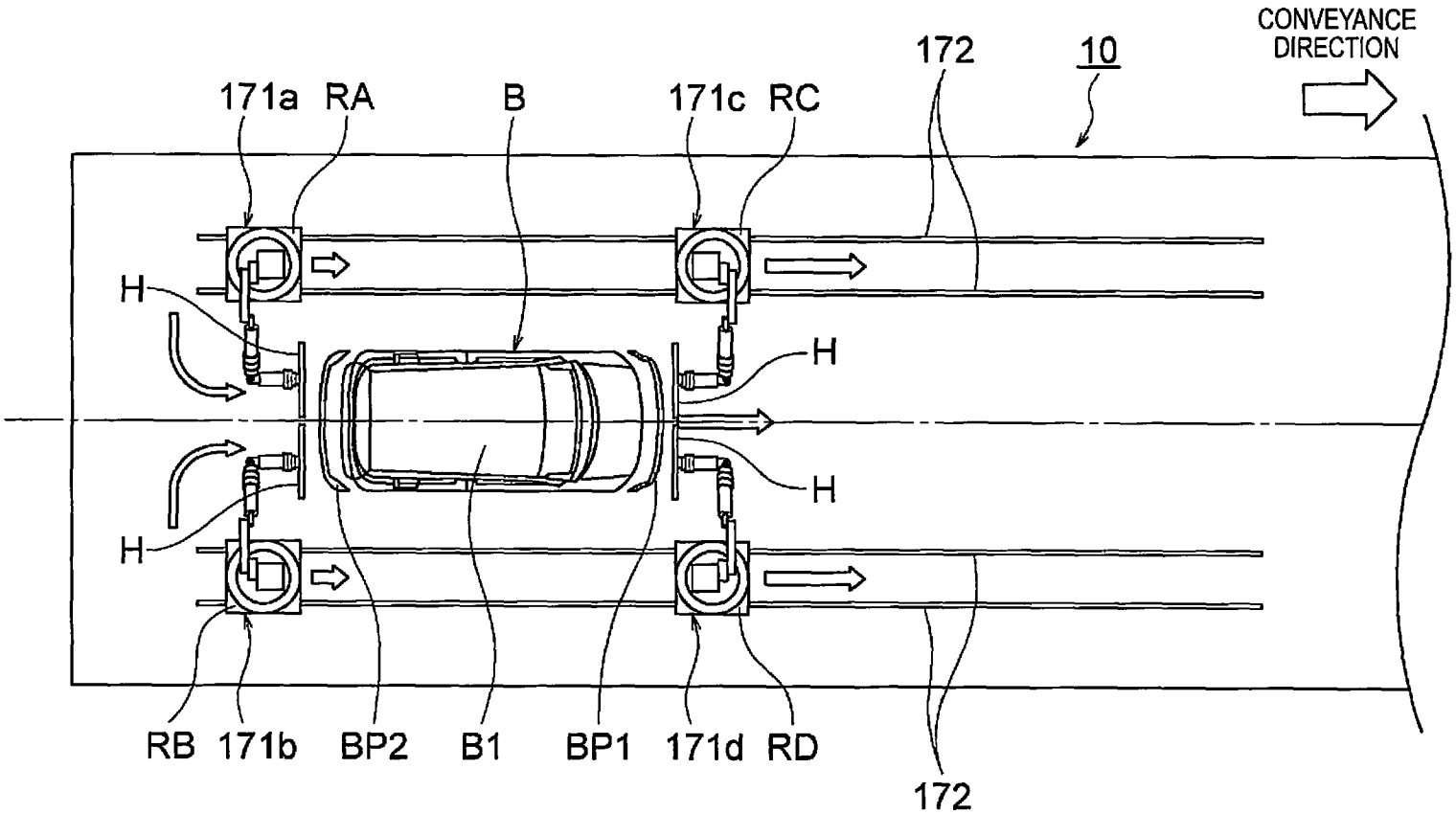
FIG. 5D is a plan view illustrating an operation (part 3) of the preheating mechanism of the preheating unit of the topcoat drying device according to one embodiment of the present invention.

FIG. 5A is a process view illustrating a topcoat drying Step P62 according to one embodiment of the present invention, FIG. 5B is a plan view illustrating an operation (part 1) of the preheating mechanism of the preheating unit of the topcoat drying device according to one embodiment of the present invention, FIG. 5C is a plan view illustrating an operation (part 2) of the preheating mechanism of the preheating unit of the topcoat drying device according to one embodiment of the present invention, FIG. 5D is a plan view illustrating an operation (part 3) of the preheating mechanism of the preheating unit of the topcoat drying device according to one embodiment of the present invention, FIG.

Figure 5E:
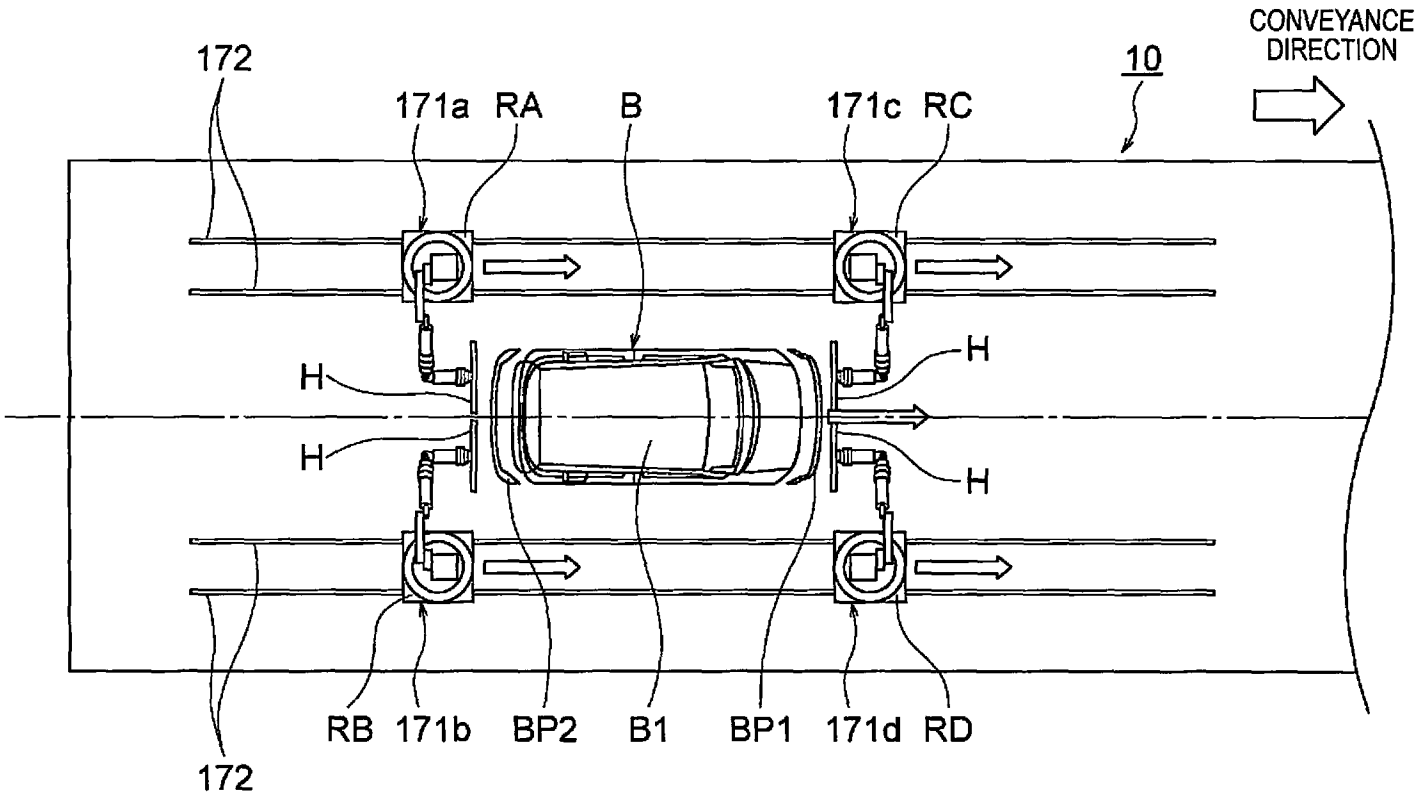
FIG. 5E is a plan view illustrating an operation (part 4) of the preheating mechanism of the preheating unit of the topcoat drying device according to one embodiment of the present invention.
Figure 5F:
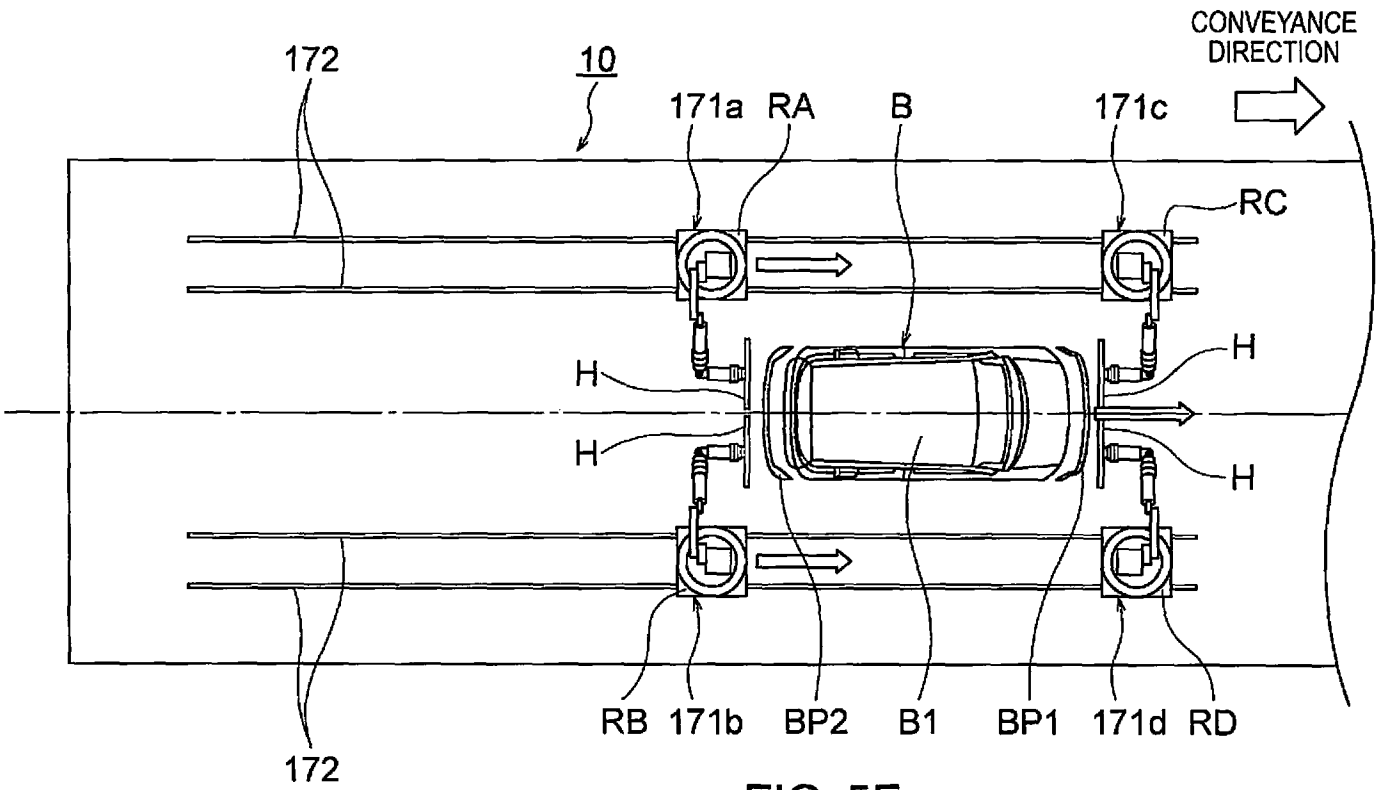
FIG. 5F is a plan view illustrating an operation (part 5) of the preheating mechanism of the preheating unit of the topcoat drying device according to one embodiment of the present invention.
Figure 5G:
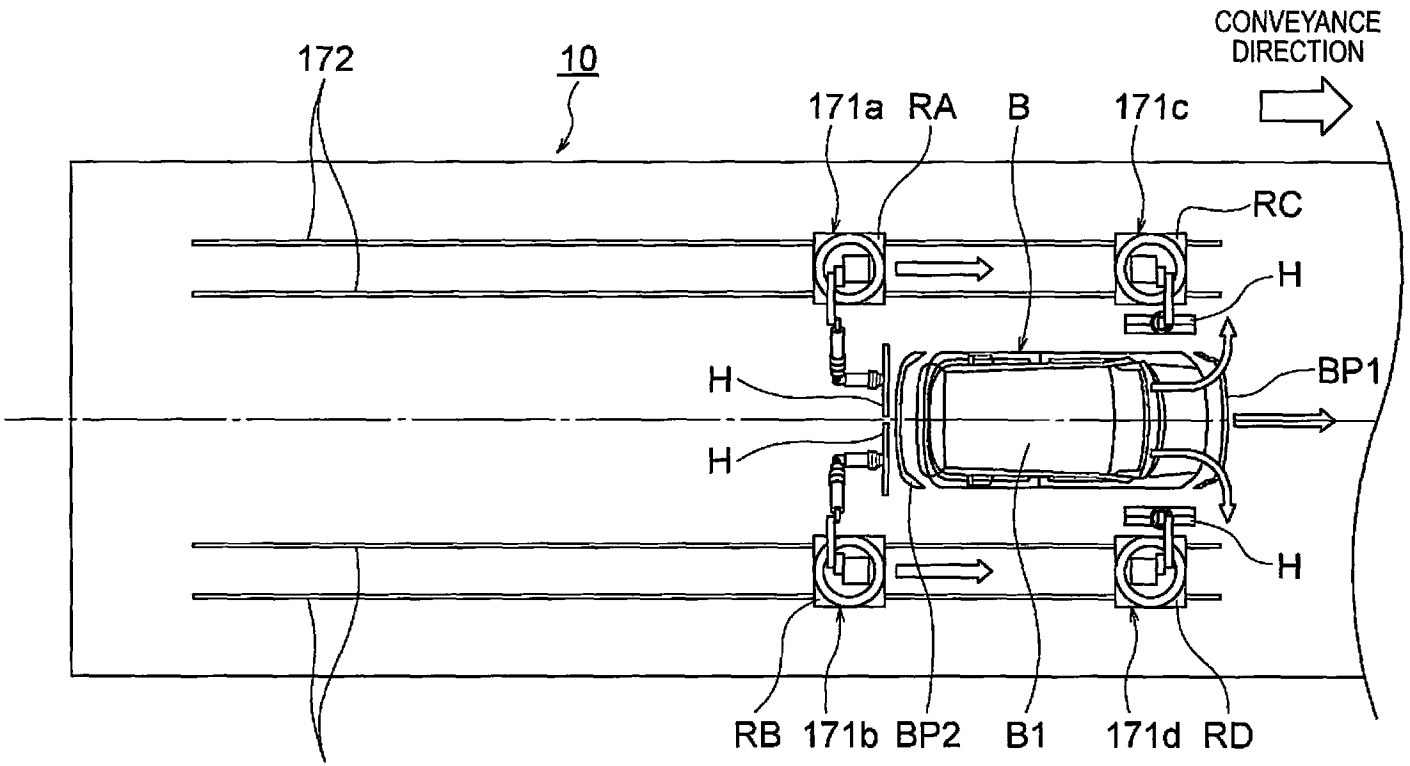
FIG. 5G is a plan view illustrating an operation (part 6) of the preheating mechanism of the preheating unit of the topcoat drying device according to one embodiment of the present invention.
Figure 5H:
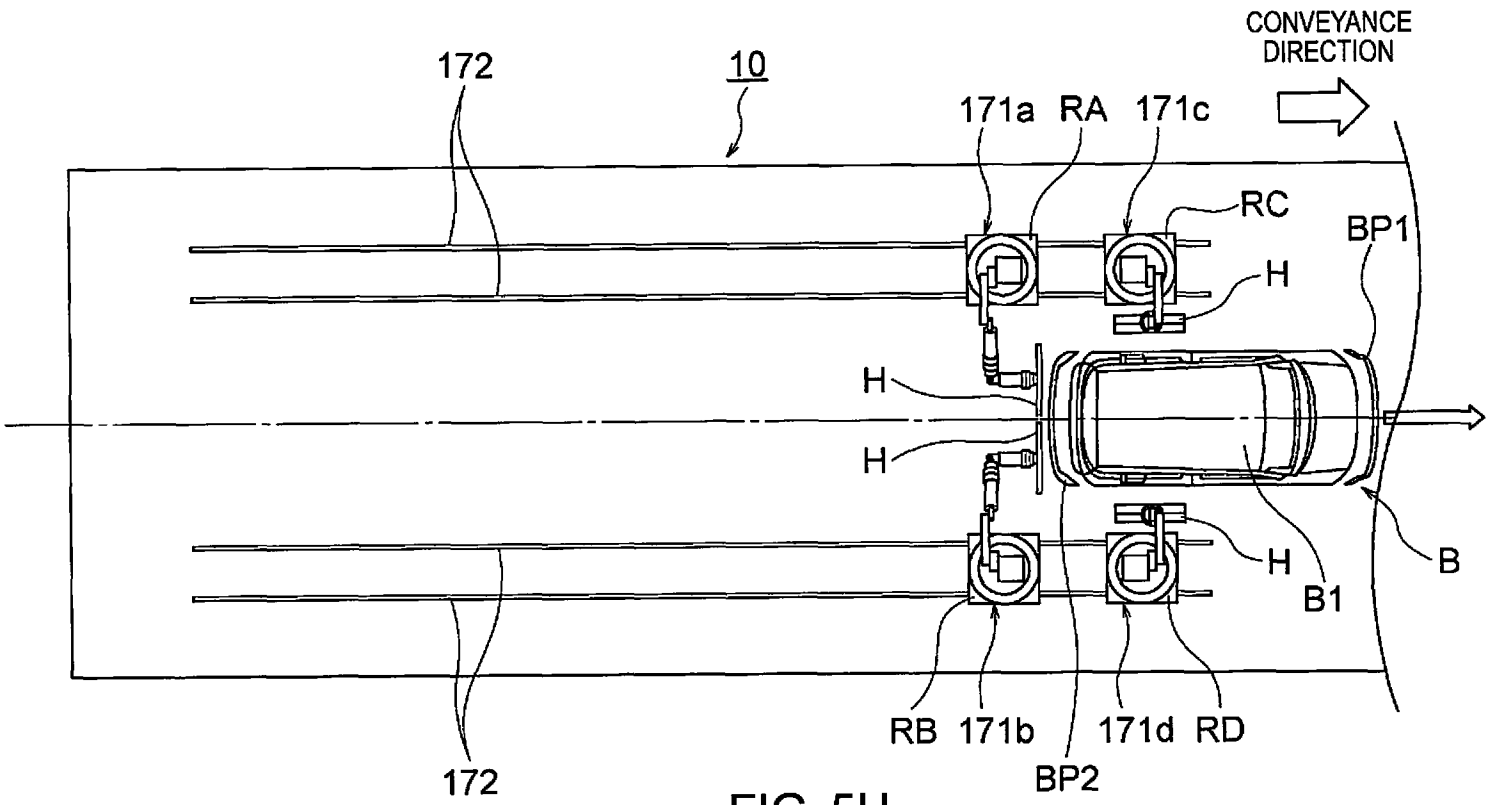
FIG. 5H is a plan view illustrating an operation (part 7) of the preheating mechanism of the preheating unit of the topcoat drying device according to one embodiment of the present invention.
Figure 5I:
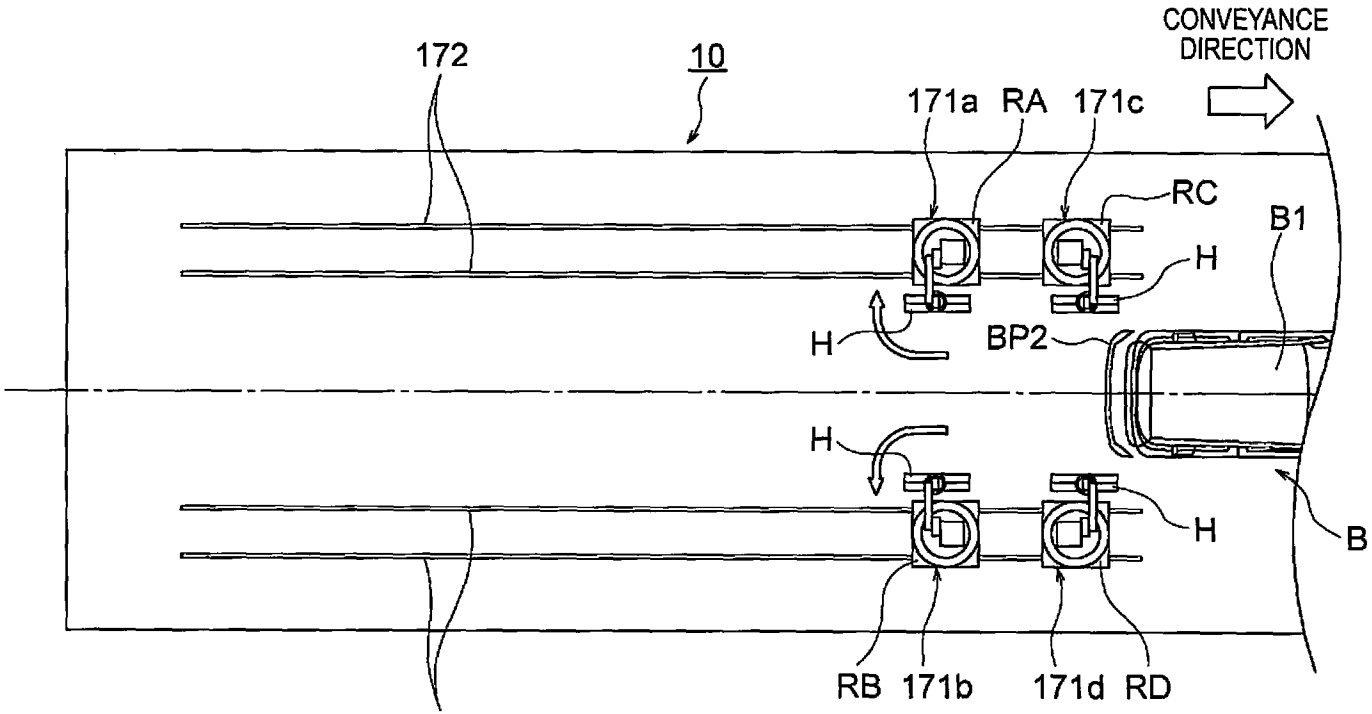
FIG. 5I is a plan view illustrating an operation (part 8) of the preheating mechanism of the preheating unit of the topcoat drying device according to one embodiment of the present invention.

5E is a plan view illustrating an operation (part 4) of the preheating mechanism of the preheating unit of the topcoat drying device according to one embodiment of the present invention, FIG. 5F is a plan view illustrating an operation (part 5) of the preheating mechanism of the preheating unit of the topcoat drying device according to one embodiment of the present invention, FIG. 5G is a plan view illustrating an operation (part 6) of the preheating mechanism of the preheating unit of the topcoat drying device according to one embodiment of the present invention, FIG. 5H is a plan view illustrating an operation (part 7) of the preheating mechanism of the preheating unit of the topcoat drying device according to one embodiment of the present invention, and FIG. 5I is a plan view illustrating an operation (part 8) of the preheating mechanism of the preheating unit of the topcoat drying device according to one embodiment of the present invention.

Said topcoat drying Step P62 comprises a pre-drying Step P621, a temperature raising Step P622, and a temperature holding Step P623, as illustrated in FIG. 5A. The "pre-drying Step P621" in the present embodiment corresponds to one example of the "pre-drying step" of the present invention; the "temperature raising Step P622" in the present embodiment corresponds to one example of the "temperature raising step" of the present invention; and the "temperature holding Step P623" in the present embodiment corresponds to one example of the "temperature holding step" of the present invention.

In the pre-drying Step P621, the bumper BP with a relatively high heat capacity is selectively heated (preheated) to dry (pre-dry) the wet-coated film that is applied to the coating surface of the bumper BP. When a coating object B is conveyed into the pre-drying unit 17 from the topcoat setting zone, the current position of the coating object B is detected by detectors, such as a limit switch provided on the floor surface and the coating platform 50, as well as from the conveyor drive signal from the transport conveyor 40. A controller C of the preheating mechanisms 171*a*-171*d* executes the instructed work according to this detected current position of the coating object B. When a coating object B is conveyed into the pre-drying unit 17 from the topcoat setting zone, each of the preheating mechanisms 171*a*-171*d* is placed in standby by folding the arm units RA2-RD2 so as to not interfere with the coating object B that is transported and moved, as illustrated in FIG. 5B.

Next, when the front bumper BP1 approaches the preheating mechanisms 171*c*, 171*d*, the heat sources H, H are opposite to the front bumper BP1 by the driving of the multi-axis robots RC, RD, as illustrated in FIG. 5C. Then, the heat sources H, H that generate heat are brought close to the front bumper BP 1, and the coating surface of the front bumper BP1 is heated by applying thermal energy thereto. At this time, the preheating mechanisms 171*c*, 171*d* start to move along the moving rails 172, following the coating object B that is continuously transported and moved by the transport conveyor 40.

Next, when the rear bumper BP2 passes in front of the preheating mechanisms 171*a*, 171*b*, the heat sources H, H are opposite to the rear bumper BP2 by the driving of the multi-axis robots RA, RB, as illustrated in FIG. 5D. Then, the heat sources H, H that generate heat are brought close to the rear bumper BP2, and the coating surface of the rear bumper BP2 is heated by applying thermal energy thereto. At this time, the preheating mechanisms 171*a*, 171*b* start to move along the moving rails 172, following the coating object B that is continuously transported and moved by the transport conveyor 40. Then, each of the preheating mechanisms 171*a*-171*d* is moved along the moving rails 172 so as to be synchronized with the movement of the transport conveyor 40 to maintain the spacing between each heat source H-H and the bumper BP within a predetermined range, as illustrated in FIG. 5E. An example of a method of maintaining the spacing between the bumper BP and the heat sources H-H within a predetermined range is to provide instructions for the positional relationship between the positions of the heat sources H-H and the bumper BP to the controller C of the multi-axis robots RA, RB, which are the preheating mechanisms 171*a*-171*d*.

Here, the magnitude of the spacing between the heat source and the heating object determines the length of time required to raise the temperature of the heating object to a predetermined temperature. For example, in the present embodiment, the time required to raise the temperature of the bumper BP to the heating temperature threshold Tc is reduced by reducing the spacing between the bumper BP and the heat source H, and the time required to raise the temperature of the bumper BP to the heating temperature threshold Tc is increased by increasing the spacing between the bumper BP and the heat source H.

In the present embodiment, each of the heat sources H-H is brought close to the bumper BP by the driving of the multi-axis robots RA-RD to reduce the time required to raise the temperature of the bumper BP to the heating temperature threshold Tc, and an appropriate distance for heating the bumper BP is maintained by keeping the spacing between the bumper BP and the heat sources H-H within a predetermined range by the driving of the multi-axis robots RA-RD.

Next, when reaching the downstream side terminus of the moving rails 172, the preheating mechanisms 171*c*, 171*d* end the synchronization with the movement of the transport conveyor 40 and stop the movement along the moving rails 172, as illustrated in FIG. 5F. The preheating mechanisms 171*a*, 171*b* are continued to be synchronized with the movement of the transport conveyor 40 to continue the movement along the moving rails 172. The preheating mechanisms 171*c*, 171*d* then fold the arm units RC2, RD2 as the conveyance unit B that is transported and moved passes in front of the preheating mechanisms 171*c*, 171*d*, as illustrated in FIG. 5G.

Next, when approaching the preheating mechanisms 171*c*-171*d*, the preheating mechanisms 171*a*, 171*b* end the synchronization with the movement of the transport conveyor 40 and stop the movement along the moving rails 172, as illustrated in FIG. 5H. Then, when the coating object B is transported and moved from the pre-drying unit 17 to the acclivitous portion 11, the preheating mechanisms 171*a*, 171*b* fold the arm units RA2, RB2, as illustrated in FIG. 5I. The preheating mechanisms 171*a*-171*d* then move to the upstream side of the moving rails 172 and are placed in standby in the original positions illustrated in FIG. 5B until the next coating object B is conveyed.

In the temperature raising Step P622, a coating object B is conveyed from the acclivitous portion 11 to the temperature raising unit 18. In this temperature raising unit 18, the entire coating object B is heated and the temperature thereof is raised to the heating temperature threshold Tc or greater. In the pre-drying unit 17, the difference in the temperature raising times between the bumper BP and the vehicle body B1 with a low heat capacity is suppressed by selectively providing thermal energy to the bumper BP with a high heat capacity to preheat the bumper BP. In the temperature holding unit 19, the coating object B is held at the above-described temperature (heating temperature threshold Tc or greater) for 15-30 minutes. Coated film applied to the coating object B is thereby baked and dried. The topcoat drying Step P62 of the present embodiment is thereby completed.

The topcoat drying device 1 in the present embodiment exhibits the following effects.

(1) The topcoat drying device 1 of the present embodiment comprises a heat source H for providing thermal energy to a coating surface of a bumper BP having a greater heat capacity than a vehicle body B1, and multi-axis robots RA-RD that cause the heat source H to approach and to separate from the bumper BP so as to maintain the spacing between the bumper BP and the heat source H within a predetermined range; and the difference between the heat-up time of the vehicle body B1 with a low heat capacity and the heat-up time of the bumper BP with a high heat capacity is suppressed by preheating the bumper BP with the heat source H. That is, with respect to the bumper BP, it is possible to suppress a reduction in the coated film performance and an occurrence of peeling of the coated film, which occur due to the drying condition of the coated film that is applied to the coating surface of the bumper BP not meeting the quality assurance specification, causing a so-called poor burning, while, with respect to the vehicle body B1, it is possible to suppress a reduction in the coated film quality caused by an occurrence of overbaking of the coated film that is applied to the coating surface of the vehicle body B1. In addition, by keeping the spacing between the bumper BP and the heat sources H-H within a predetermined range by the driving of the multi-axis robots RA-RD, an appropriate distance is maintained for heating the bumper BP, and the drying of the wet-coated film that is applied to the coating surface of the bumper BP is promoted. In this manner, in the present embodiment, the uniformity of drying conditions across the entire coated film region of the coating object B is achieved, and it is possible to satisfy the quantity assurance specification of the coated film that is applied to each of the vehicle body B1 and the bumper BP, which have different heat capacities. In addition, regarding the vehicle body B1, it is possible to suppress the consumption of wasteful energy in which coated film that is applied to the coating surface of the vehicle body B1 far exceeds the quality assurance standard.

(2) Additionally, in the present embodiment, the heat-up time of the bumper BP in the temperature raising unit 18 is reduced by preheating the bumper BP with a high heat capacity. The entire length of the raised floor portion 12 of the drying furnace main body 10 is thereby reduced, and thus it is possible to reduce capital investment.

(3) In addition, in the present embodiment, by using an infrared heater, a halogen heater, an induction heater, or hot air as the heat source H, it is possible to provide intense thermal energy to the coating surface of the target bumper BP and to prevent the generation of airborne dust, etc., compared to with forced hot air systems.

(4) Additionally, in the present embodiment, by moving the heat source H so as to follow the transport and movement of the coating object B by the driving of the multi-axis robots RA-RD, it is possible to preheat the bumper BP of the continuously transported coating object B over a relatively long period of time. The time required to raise the temperature of the bumper BP in the temperature raising unit 18 is further reduced.

(5) In addition, in the present embodiment, the vehicle body B1 and the bumper BP of the coating object B are mounted on the coating platform 50 such that the positional relationship therebetween is essentially matched to the finished vehicle which has completed the outfitting step, and the vehicle body B1 and the bumper BP are subjected to topcoating at the same time. It is thereby possible to suppress an occurrence of hue shift between the vehicle body B1 and the bumper BP and to obtain an automobile with an excellent appearance.

(6) Additionally, in the present embodiment, it is possible to dispense with a separate finish coating step carried out solely for the bumper BP and integrate same with the top coating Step P6 of the coating line by subjecting the vehicle body B1 and the bumper BP to topcoating at the same time. It is thereby possible to further reduce capital investment. In addition, since the vehicle body B1 and the bumper BP are not made into a lot, as in the prior art described above, and are passed through the coating line PL mounted on the same coating platform 50, it is possible to prevent production order dislocations.

The embodiments described above are described in order to facilitate understanding of the present invention, and are not described in order to limit the present invention. Therefore, the elements disclosed in the embodiments above are intended to include all design modifications and equivalents thereto that lie within the technical range of the present invention.

For example, in the present embodiment, the coating objects B of the vehicle body that are conveyed to the coating line PL are all of the same vehicle type, but no limitation is imposed thereby, and the coating line may be a multi-model mixed line to which are conveyed different vehicle types.

In addition, in the present embodiment, a bumper BP is mounted on the coating platform 50 as the resin member, but no limitation is imposed thereby, and the resin member may be one type, or two or more types selected from air spoilers, door mirror covers, front grills, various finishers, and door fasteners.

Additionally, in the present embodiment, a metal material such as steel is used as the material that forms the vehicle body B1, and a resin material is used as the material that forms the bumper BP, but no limitation is imposed thereby. For example, as long as the materials have different heat capacities, resin materials may be used in either of the material that forms the vehicle body B1 and the material that forms the bumper BP.

In addition, in the present embodiment, the vehicle body B1 is the first part and the bumper BP is the second part, but no limitation is imposed thereby. For example, when the vehicle body B1 is formed comprising materials with different heat capacities, the material with a low heat capacity of the materials that form the vehicle body B1 may be the first part, and the material with a high heat capacity of the materials that form the vehicle body B1 may be the second part. Specifically, while not particularly limited, for example, the first part may be steel, and the second part may be aluminum.

The invention claimed is:

1. A coat drying device for drying a wet-coated film applied to a coating surface of a continuously transported coating object, the coating object comprising a vehicle body and a bumper having a greater heat capacity than a heat capacity of the vehicle body, the coat drying device comprising:

a drying furnace main body; and a controller, the drying furnace main body including a transport conveyor configured to transport the coating object in a conveyance direction, a pre-drying unit including a heat source and a heat source moving device, the heat source being configured to emit thermal energy, the heat source moving device being configured to movably hold the heat source, and a temperature raising unit and a temperature holding unit configured to blow hot air from a hot air generation supply device onto all of the coating object and dry the coated film applied to the coating object, the temperature raising unit and the temperature holding unit being disposed downstream of the pre-drying unit in the conveyance direction, the controller being configured to control the pre-drying unit such that the heat source moving device moves the heat source to the bumper and holds the heat source such that a spacing between the bumper and the heat source is maintained within a predetermined range, thereby providing the thermal energy predominately to a coating surface of the bumper to pre-dry the wet-coated film on the coating surface of the bumper.

2. The coat drying device according to claim 1, wherein the heat source includes one of an infrared heater, a halogen heater, an induction heater and a hot air generating device.

3. The coat drying device according to claim 1, wherein the controller is configured to control the heat source moving device to move the heat source so as to follow a transport movement of the coating object while maintaining the spacing between the bumper and the heat source within the predetermined range.

4. The coat drying device according to claim 1, wherein the heat source moving device is a robot configured to move along a rail.

5. A coat drying method for drying a wet-coated film applied to a coating surface of a continuously transported coating object that includes a first part and a bumper having a greater heat capacity than a heat capacity of the first part, the coat drying method comprising:

moving a heat source configured to emit thermal energy to a position where a spacing between the heat source and the bumper of the coating object is within a predetermined range;

maintaining the spacing within the predetermined range while providing the thermal energy primarily to the coating surface of the bumper of the coating object to pre-dry the wet-coated film on the coating surface of the bumper of the coating object; and after pre-drying the wet-coated film on the coating surface of the bumper of the coating object, blowing hot air on all of the coating object to raise and hold a temperature of the entire coating object and dry the coated film applied to the coating object.

6. The coat drying method according to claim 5, wherein the heat source includes one of an infrared heater, a halogen heater, an induction heater and a hot air generating device.

7. The coat drying method according to claim 5, wherein during the drying of the wet-coated film on the coating surface of the bumper of the coating object, the heat source is moved so as to follow a transport movement of the coating object while maintaining the spacing within the predetermined range.

8. The coat drying method according to claim 5, wherein the heat source is moved by a robot.

* * * * *